US008779921B1

(12) United States Patent
Curtiss

(10) Patent No.: US 8,779,921 B1
(45) Date of Patent: Jul. 15, 2014

(54) ADAPTIVE SECURITY NETWORK, SENSOR NODE AND METHOD FOR DETECTING ANOMALOUS EVENTS IN A SECURITY NETWORK

(75) Inventor: David Curtiss, Bastrop, TX (US)

(73) Assignee: Solio Security, Inc., Austin, TX (US)

( * ) Notice: Subject to any disclaimer, the term of this patent is extended or adjusted under 35 U.S.C. 154(b) by 663 days.

(21) Appl. No.: 12/780,655

(22) Filed: May 14, 2010

(51) Int. Cl.

| | |
|---|---|
| ***G08B 13/00*** | (2006.01) |
| ***G08B 25/00*** | (2006.01) |
| ***G08B 19/00*** | (2006.01) |
| ***G08B 29/00*** | (2006.01) |

(52) U.S. Cl.
USPC ..... 340/541; 340/524; 340/525; 340/521; 340/522; 340/506

(58) Field of Classification Search
USPC ..... 340/541, 524, 525, 521–522; 248/152–155
See application file for complete search history.

(56) References Cited

U.S. PATENT DOCUMENTS

| | | | | |
|---|---|---|---|---|
| 4,857,912 | A * | 8/1989 | Everett et al. | 340/508 |
| 5,914,655 | A * | 6/1999 | Clifton et al. | 340/506 |
| 6,208,247 | B1 | 3/2001 | Agre et al. | |
| 6,288,640 | B1 * | 9/2001 | Gagnon | 340/539.17 |
| 6,405,318 | B1 * | 6/2002 | Rowland | 726/22 |
| 6,934,426 | B2 * | 8/2005 | Rich et al. | 385/12 |
| 6,989,745 | B1 * | 1/2006 | Milinusic et al. | 340/541 |
| 7,020,701 | B1 | 3/2006 | Gelvin et al. | |
| 7,049,952 | B2 | 5/2006 | Kulesz et al. | |
| 7,250,855 | B2 | 7/2007 | Suenbuel et al. | |
| 7,418,733 | B2 * | 8/2008 | Connary et al. | 726/25 |
| 7,433,648 | B2 | 10/2008 | Bridgelall | |
| 7,450,006 | B1 * | 11/2008 | Doyle et al. | 340/541 |
| 7,504,940 | B2 | 3/2009 | Luebke et al. | |
| 7,624,448 | B2 * | 11/2009 | Coffman | 726/23 |
| 7,644,365 | B2 * | 1/2010 | Bhattacharya et al. | 715/736 |
| 8,274,377 | B2 * | 9/2012 | Smith et al. | 340/286.02 |
| 2002/0133294 | A1 * | 9/2002 | Farmakis et al. | 701/301 |
| 2004/0103139 | A1 | 5/2004 | Hubbard et al. | |
| 2006/0028334 | A1 * | 2/2006 | Adonailo et al. | 340/522 |
| 2006/0187017 | A1 * | 8/2006 | Kulesz et al. | 340/506 |
| 2006/0197665 | A1 * | 9/2006 | Shibata et al. | 340/557 |
| 2006/0220843 | A1 * | 10/2006 | Broad et al. | 340/539.23 |
| 2007/0003146 | A1 | 1/2007 | Ko et al. | |
| 2007/0012349 | A1 | 1/2007 | Gaudiana et al. | |

* cited by examiner

*Primary Examiner* — Daniel Wu
*Assistant Examiner* — Mohamed Barakat
(74) *Attorney, Agent, or Firm* — Kevin L. Daffer; Daffer McDaniel LLP

(57) ABSTRACT

An adaptive security network, sensor node and methods for detecting and responding to anomalous events in a security network are provided herein. In general, the adaptive security network comprises a plurality of sensor nodes interconnected to form a communication network, wherein each sensor node is configured for detecting an anomalous event occurring within a vicinity of the sensor node and for identifying the detected anomalous event as a specific threat-event, a specific non-threat event or an unidentified event. In addition, the adaptive security network comprises a central processing and control system coupled to the plurality of sensor nodes for receiving an event notification message from at least one of the sensor nodes indicating an identity of an anomalous event detected by the at least one sensor node. Upon receiving the event notification message, the central processing and control system is configured for confirming the identity of the anomalous event provided by the at least one sensor node and for responding to the anomalous event once the identity is confirmed.

27 Claims, 15 Drawing Sheets

Method performed by Sensor Nodes for monitoring sensor data and detecting events Security Network Potential applications for sensor nodes Block Diagram of Sensor Node Back View Front View Example of event known signatures Central Processing & Control System Method performed by Sensor Nodes for monitoring sensor data and detecting events Method performed by Central Processing and Control System for processing event notifications Block diagram of User Interface Example User Interface Sensor Node/Zone Configuration module Example of Single Node Configuration Example of Zone Configuration Example of Alarm Condition Status Example showing details of Alarm Condition Activity Schedule Window

ADAPTIVE SECURITY NETWORK, SENSOR NODE AND METHOD FOR DETECTING ANOMALOUS EVENTS IN A SECURITY NETWORK

BACKGROUND OF THE INVENTION

1. Field of the Invention

This invention relates to property and perimeter security networks and, more particularly, to security networks having significantly greater configurability and adaptability to environmental conditions.

2. Description of the Related Art

The following descriptions and examples are given as background only.

Individuals and enterprises, including corporate, municipal, government and military enterprises, are increasingly concerned with the issue of property and perimeter security. Significant investments are made each year to secure property and perimeters in a wide variety of installations, such as corporate campuses, manufacturing plants, chemical plants, energy and water infrastructure, government buildings, airports, storage depots, utility substations and military bases.

Conventional security systems often rely on an individual sensor technology, or a combination of different sensor technologies, to monitor a security network for "threat events," or events or actions that pose a risk to security. In building security, for example, magnetic door sensors are commonly used to monitor the opening and closing of a door or gate. Motion sensors are also commonly employed in building and perimeter security systems to alert security personnel to the presence of a possible intruder. In some cases, magnetic door sensors and motion sensors are combined within a security network to increase the level of protection. However, the different sensor technologies are usually monitored independently for threat events.

Conventional security systems configured to monitor a perimeter typically do so by attaching a sensing cable to a barrier or fence surrounding a building, facility, campus or other property, and an alarm is generated if the sensing cable is disturbed for any reason. In some cases, the disturbance may be caused by a threat event, such as an attempted or successful intrusion. However, the sensing cable may also be disturbed by a non-threat event, such as an animal brushing up against the fence, or some other environmental event (such as weather).

Conventional security systems are inadequate for many reasons, including but not limited to, efficiency of threat detection, accuracy of threat detection, and the inability to determine the exact location of a threat. For example, a single faulty sensor could generate false data, thereby causing the system to generate a false alarm. False or nuisance alarms may also be generated due to the inability of conventional systems to distinguish threat events from environmental conditions.

Many modern large scale security systems include thousands of sensors. Once the system alerts personnel to a potential threat event, the personnel are tasked with investigating the event to evaluate whether or not it is an actual threat to security. For sites in remote locations, the dispatched personnel are hindered when they do not know the exact location of the event. This gives the perpetrator more time to cause damage and escape. In such an environment, dispatching personnel to investigate non-threatening events and delaying the interruption or apprehension of an intruder is a waste of time and resources.

Often times, individuals and enterprises will install multiple individual security systems in an attempt to achieve a desired level of protection. However, scalability is a limitation for all systems. As the size of the area to be protected increases, so do the infrastructure requirements necessary to support such systems. For instance, the cabling needed in conventional security systems to connect power and communications, as well as the labor needed to install these systems, can greatly impact the cost of a project. This is true for single technology applications and is exacerbated when multiple sensor technologies are combined.

Attempts have been made to improve the scalability, efficiency and accuracy of conventional security systems. For example, U.S. Pat. No. 7,450,006 to Doyle et al. describes a distributed perimeter security threat confirmation system in which a plurality of sensor systems, or nodes, are interconnected to form a security network. Doyle reduces false alarms and increases accuracy by providing intelligent sensor nodes, which are capable of confirming threats via inter-sensor communication. Doyle also improves scalability and efficiency by performing the threat evaluation at the sensor node, instead of at a central control system. This reduces the processing requirements of the central control system, which is included merely for transferring threat notifications to a user interface system, where they can be displayed to a user. Distributing threat evaluations to the sensor nodes also reduces the time and effort required of personnel to investigate the events, as the sensor nodes responsible for issuing the threat notifications will provide indication of the location of the threat.

However, security systems such as those described by Doyle, are still lacking in many areas. For example, although such systems are capable of detecting non-threat events (such as wind or rain), they lack the configurability and flexibility needed to adapt the threat evaluation algorithms to changes in the environment, which could mask true security threats. Consider, for a moment, that it is raining. In Doyle's system, a sensor node may detect a rain event, communicate with one or more other nodes to confirm the rain event, and upon confirmation, generate and transmit an event message to the central control system identifying the rain event. However, as it is raining, an intruder may attempt to breach the security perimeter. If the intruder's attempts cause disturbances on a level similar to those produced by the rain, the real security threat may be masked by the rain response and go undetected.

A need exists for a security network having greater configurability and adaptability. Specifically, a need exists for a security network that adapts to changes in the environment so that the security network may tune-out non-threat events, while continuing to monitor the network for true security threats. In addition to changes in environment, an adaptive security network is needed with the capability for identifying new events that have not yet been identified by the network and predicting future events, which may present a threat to security. Such a security network is currently lacking in the prior art and accomplished by the invention set forth herein.

SUMMARY OF THE INVENTION

The following description of various embodiments of security networks, sensor nodes, methods for detecting anomalous events and methods for responding to detected events is not to be construed in any way as limiting the subject matter of the appended claims.

According to one embodiment, a security network is provided for monitoring property, infrastructure and/or perimeters. In general, the security network may include a plurality of sensor nodes, a central processing and control system, a user interface system and one or more response systems. The plurality of sensor nodes are interconnected to form a communication network, which in some embodiments, may be wired or wireless. Each of the sensor nodes is configured for detecting an anomalous event occurring within a vicinity of the sensor node, identifying the detected anomalous event as a specific threat-event, a specific non-threat event or an unidentified event, and generating an event notification message identifying the detected event.

The central processing and control system is coupled for receiving event notification messages from one or more of the sensor nodes indicating the identity of the anomalous event detected by the one or more sensor nodes. Upon receiving an event notification message, the central processing and control system is generally configured for confirming the identity of the anomalous event provided by the sensor node(s), and for responding to the anomalous event once the identity is confirmed. The manner in which the central processing and control system responds to a confirmed event may generally depend on the type of anomalous event detected. Different responses will be generated for different threat events, non-threat events and unidentified events.

For example, if the central processing and control system confirms the identity of an anomalous event as a specific threat event, the central processing and control system may generate an alarm signal attributed to the at least one sensor node, and forward the alarm signal to the user interface system for displaying and alerting a user to the specific threat event at the at least one sensor node. In addition, the central processing and control system may respond to the alarm signal based on a priority setting specified for the specific threat event, and store details of the specific threat event within an event log.

On the other hand, if the central processing and control system confirms the identity of an anomalous event as a specific non-threat event, the central processing system may generate a warning signal attributed to the at least one sensor node, and forward the warning signal to a user interface system of the security network for displaying and alerting a user to the specific non-threat event at the at least one sensor node. In addition to storing details of the specific non-threat event within an event log, the central processing and control system may send instructions to the at least one sensor node for responding to the specific non-threat event.

If the central processing and control system confirms the identity of an anomalous event as being unidentified, the central processing and control system may store details of the unidentified event within an event log for further analysis. The stored details may be analyzed by the central processing and control system for identifying the unidentified event as a new event, predicting the occurrence of a future threat event or detecting a node malfunction.

The user interface system communicates with the central processing and control system for displaying details about the security network and for receiving input from a user of the security network to configure the security network and to respond to events. In a preferred embodiment, the user interface system comprises a graphical user interface (GUI) including a user-interactive map of the security network for displaying the location and status of each of the sensor nodes. In addition, the GUI may comprise graphical and textual means for displaying details of events detected by the sensor nodes, displaying a historical log of events associated with one or more of the sensor nodes, and selecting operational settings for one or more of the sensor nodes.

If an alarm signal is generated in response to a confirmed threat, the central processing and control system may also activate one or more response systems for responding to the alarm. The one or more response systems may include any number and/or type of response system, including but not limited to, silent alarms, audible alarms and sirens, cameras, recording devices, lights, radios, locks and other security and communication devices. Thus, the central processing and control system may respond to a threat event by activating an audible or silent alarm, initiating a security lock-down, activating a video camera and/or video recording device, dispatching security personnel, just to name a few. In general, the alarm response may be dictated by the type of threat identified by the system and the priority level assigned to that event.

According to another embodiment, a sensor node is provided herein for detecting and identifying anomalous events that occur within the security network. In general, the sensor node may comprise at least one sensor coupled for acquiring data pertaining to the security network, a storage medium coupled for storing a set of program instructions for detecting an anomalous event within the sensor data and for classifying the detected event as a threat-event, a non-threat event, or an unidentified event; and a processor coupled for executing the set of program instructions. In some embodiments, the at least one sensor may comprise a plurality of sensors, at least some of which comprise a different sensor technology (e.g., the sensor node may include a motion sensor, a proximity sensor and a chemical/radiation sensor). The sensor node may also include additional components, such as one or more transceivers for communicating with the central processing and control system, a power cell for providing power to the sensor node and an energy harvesting device for recharging the power cell. Other components may also be included as described herein.

According to another embodiment, a method is provided for detecting anomalous events at a sensor node arranged within a security network comprising a plurality of sensor nodes controlled by a central processing and control system. The method is typically embodied as program instructions and stored within the storage medium of the sensor nodes. As such, the method performed at the sensor node may generally include program instructions for acquiring data pertaining to the security network; detecting an anomalous event within the sensor data; and classifying the detected anomalous event as a threat-event, a non-threat event, or an unidentified event. If the method classifies the detected anomalous event as a non-threat event, the sensor node may receive instructions from the central processing and control system for responding to the non-threat event.

The steps of detecting and classifying may include program instructions for comparing the sensor data to event signatures stored within the sensor node, wherein the stored event signatures correspond to previously identified anomalous events, including threat events and non-threat events. The sensor data may or may not match one of the stored event signatures.

If the sensor data does not match any of the stored event signatures, the method may comprise further program instructions for determining if the sensor data contains any suspicious attributes. If suspicious attributes are detected, the method may comprise further program instructions for detecting an unidentified event; generating an unidentified event notification message; and transmitting the unidentified event notification message to the central processing and control system.

If the sensor data substantially matches one or more of the stored event signatures, the method may comprise further program instructions for applying a set of event property filters corresponding to the matching event signature to the sensor data; detecting an anomalous event if the sensor data satisfies the set of event property filters; and classifying the detected event as one of the previously identified anomalous events, wherein the classifying step identifies the threat-event or the non-threat event corresponding to the matching event signature. In some embodiments, one or more event property filters may be applied to the sensor data before the data is compared to the stored event signatures.

After the event is classified and identified, the method comprises further program instructions for generating an event notification message including the identified threat-event or non-threat event; and transmitting the event notification message to the central processing and control system. As noted above, the central processing and control system may respond to the event notification message in a variety of different ways dependent on the type of anomalous event detected and identified in the event notification message. Methods used by the central processing and control system for confirming events detected by the sensor nodes and responding to the confirmed events are also provided herein.

BRIEF DESCRIPTION OF THE DRAWINGS

Other objects and advantages of the invention will become apparent upon reading the following detailed description and upon reference to the accompanying drawings in which.

Figure 1:
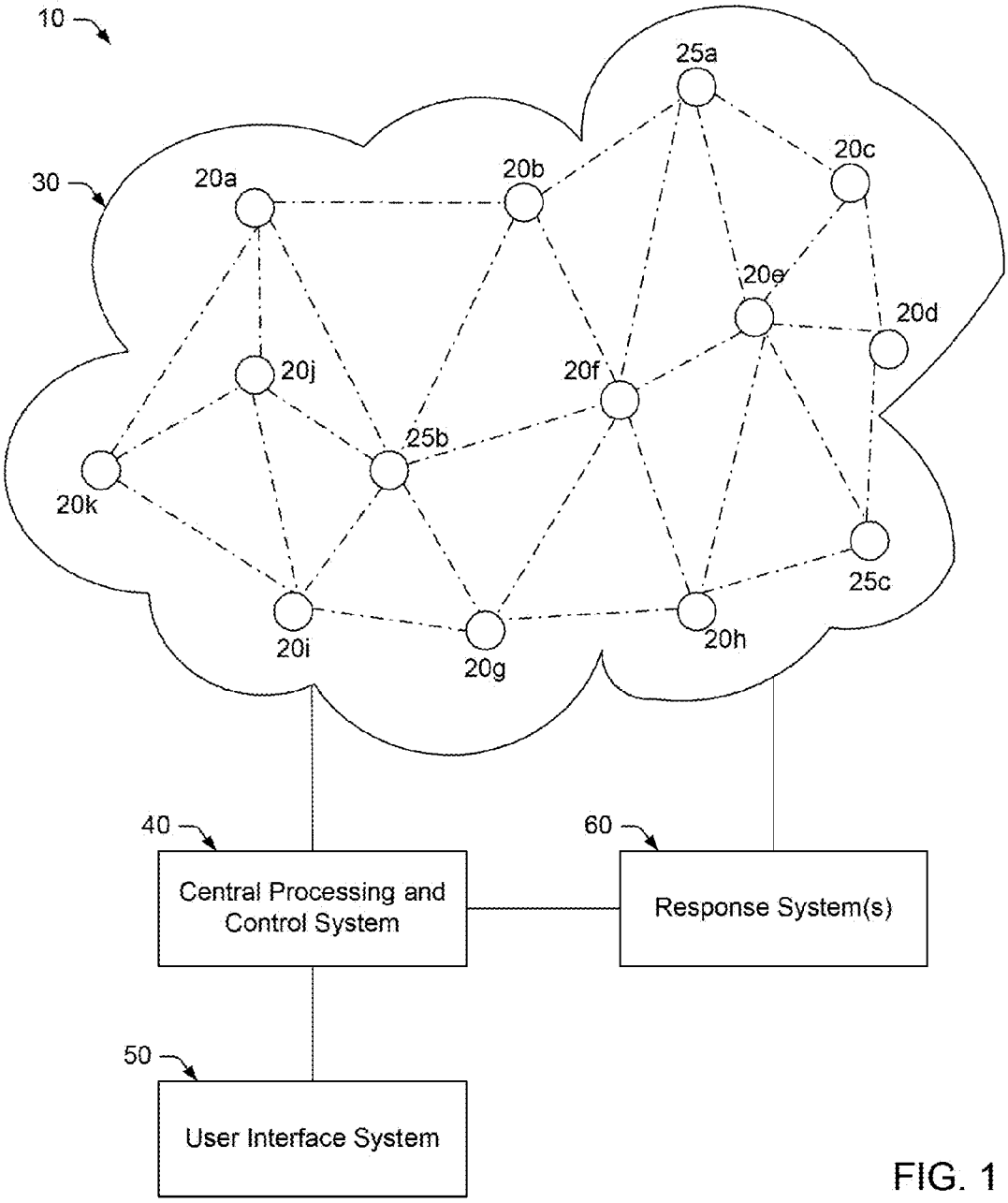
FIG. 1 is a block diagram illustrating an embodiment of a security network comprising a plurality of sensor nodes, a central control system, a user interface and one or more response systems.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning now to the drawings, various embodiments of an improved security network, sensor node and methods for detecting and responding to anomalous events in a security network are illustrated in FIGS. 1-15. As will become apparent in the description set forth below, the security network described herein comprises several improvements, which provide the network with significantly greater configurability and adaptability than conventional security networks. As such, the improved security network significantly increases accuracy and efficiency of threat detection and response.

The security network components shown in FIGS. 1-15 are described below with reference to specific embodiments, which teach those skilled in the art how to make and use the best mode of the invention. However, one skilled in the art will recognize variations and/or combinations of these embodiments that fall within the overall scope of the invention. As such, the invention is not limited to the specific embodiments described herein, but only by the features recited in the claims and their equivalents.

I. A General Embodiment of an Improved Security Network

FIG. 1 is a block diagram illustrating an improved property and/or perimeter security system 10 comprising a plurality of sensor nodes 20*a*-20*k* (referenced generally by 20) interconnected to form a network 30. As described in more detail below, each sensor node is configured to collect data pertaining to its environment, process the data for detecting anomalous events, and classify the detected events as either threat events, non-threat events or unidentified events. Once an anomalous event has been detected and classified by a sensor node, the sensor node will generate and transmit an event notification message identifying the event to a central processing and control system 40. Upon receiving an event notification message, the central processing and control system 40 is generally configured for confirming the identity of the anomalous event detected by the sensor node, and for responding to the anomalous event once confirmation has been made.

As used herein, an "anomalous event" is any irregular event or action which substantially disturbs one or more of the sensor nodes 20. An "anomalous event" may be classified as a threat event, a non-threat event or a previously unidentified event.

A "threat event" is any event or action, which has been previously identified by the system or a user of the system as being a threat to security. Such events may include, but are certainly not limited to, attempts to cut, climb or otherwise impact a protected fence or barrier, attempts to lift or move an object, unauthorized motion in an area, unauthorized vehicle engine running, detection of hazardous materials, attempts to disable the security system, etc.

A "non-threat event" is any irregular event or action that substantially disturbs the sensor nodes, but is known to not pose a threat to security. Examples of non-threat events include weather-related events (such as rain, sleet, hail, wind, etc.) and other environmental factors and acts of nature (such as those caused by birds and animals).

An "unidentified event" is an anomalous event which has not yet been identified by the system as a known threat event or a known non-threat event. In some cases, the unidentified event may be a "new" threat or non-threat event, wherein a "new" event refers to an event that has not yet been identified and learned by the system or user of the system. In other cases, the unidentified event may be an irregular event, which does not quite meet the requirements of a known threat, but has suspicious attributes that may lead the system to predict a potential future threat.

Central processing and control system 40 may respond to an anomalous event in a variety of ways, depending on the confirmed identity of the anomalous event and the response priority level assigned to that event. At the very least, the central processing and control system 40 will generate and transmit an alarm signal (in the case of a threat event) or a warning signal (in the case of a non-threat or unidentified event) to a user interface system 50, so that a user of the system may be alerted to the anomalous event detected by the sensor node. If an alarm signal is generated in response to a confirmed threat, the central processing and control system 40 may also activate one or more response systems 60 for responding to the alarm.

The one or more response systems 60 may include any number and/or type of response system, including but not limited to, silent alarms, audible alarms and sirens, cameras, recording devices, lights, radios, locks and other security and communication devices. Thus, the central processing and control system 40 may respond to a threat event by activating an audible or silent alarm, initiating a security lock-down, activating a video camera and/or video recording device, dispatching security personnel, just to name a few. In some cases, the alarm response may be dictated by the type of threat identified by the system and the priority level assigned to that event.

As shown in FIG. 1, sensor nodes 20 are interconnected to form a network 30, which is monitored and controlled by central processing and control system 40 and user interface system 50. Network 30 may comprise one or more networks, such as wide area networks (WANs), local area networks (LANs), and the like, which may or may not be linked by the Internet. Network communications may be carried out over wired links, wireless links or a combination of both.

In one embodiment, a plurality of sensor nodes 20 is arranged around the perimeter of a facility to form a wireless local area network (i.e., a wireless LAN). The central processing and control system 40 is connected to the wireless LAN for communicating with the sensor nodes 20. The user interface system 50 is also connected to the wireless LAN for configuring the sensor nodes 20 and for displaying details about the security network. In some cases, the central processing and control system 40 and the user interface system 50 may each be located "on-site" (e.g., within or close to the protected facility, possibly within the same machine, or within two or more interconnected machines), so that components 20, 40 and 50 are included within a single local area network 30. In other cases, the central processing and control system 40 and/or the user interface system 50 may located "off-site" and connected to local area network 30 through a wide area network, such as the Internet or a private Intranet.

Sensor nodes 20 communicate with each other to relay information to and from central processing and control system 40. In general, sensor nodes 20 may communicate with each other and with central processing and control system 40 over communication links 70, which as indicated above, may be implemented as wired links, wireless links or a combination of both. In one preferred embodiment, sensor nodes 20 communicate over wireless communication links via one or more radio frequency (RF) transceivers. However, sensor node communication is not limited to radio frequency and may be implemented with any other suitable wired or wireless communication links. In one alternative embodiment, for example, a pair of infrared (IR) transceivers may be included within each of the sensor nodes for connecting the sensor nodes in a daisy chain. An example of a suitable wired communication link is a CAT5 link. In some embodiments, one or more sensor nodes may communicate over wired links when the sensor nodes are deployed in areas where radio signal strength is diminished and/or the available sunlight is not sufficient to charge the batteries (such as indoors).

When radio frequency transceiver(s) are included within the sensor nodes 20, an ad-hoc, self-forming, self-healing wireless mesh local area network 30 can be established when one or more sensor nodes are active and within radio range of the central processing and control system 40. Wireless communications between the sensor nodes 20 and the central processing and control system 40 propagate through the network 30 in a series of "hops." Information is preferably transmitted between nodes in the network using an ad-hoc routing scheme. That is, the path that data takes through the network is not determined beforehand, but rather, determined by each node as the node receives the data. Ad-hoc routing is well known in the art, and thus, will not be described fully herein.

An advantage of using a radio frequency network is that it is highly scalable, self-forming and self-healing. Additional nodes can be added or existing nodes can be removed from the network with relative ease. When adding new sensor nodes to the network, the new sensor node may automatically locate itself within the network upon activation. For example, a new sensor node may have GPS capabilities and/or may communicate with existing sensor nodes to automatically orient itself within the network. Alternatively, the location of a new sensor node in the network may be entered into the node manually by a technician or user installing the node.

In some embodiments, one or more portable network coordinators can be added to expand the number of nodes that can be supported by the network, as well as to provide a long range data connection. The addition of portable network coordinators can also reduce the number of communication cycles (or "hops") performed by the sensor nodes which results in lower power consumption by the sensor nodes.

Portable network coordinators (PNCs) are depicted in FIG. 1 at nodes 25*a*-25*c*. The PNCs 25 generally function to manage and relay communications between the sensor nodes 20 and the central processing and control system 40. Data from the sensor nodes 20 passes to the PNCs, which relay the data to the central processing and control system 40. The addition of PNCs 25 enables the network 30 to be segmented into territories, and the PNCs are typically spaced such that they are capable of overlapping into the territory of neighboring PNCs (to provide redundancy). This segmentation increases the efficiency of communication by reducing the number of "hops" needed for communication data to reach the central controller 40. For example, instead of requiring 6-8 hops for data to pass from node to node until it reaches the central controller, the number of hops required may be reduced to 2 or 3 with the addition of a PNC 25. In addition to increased efficiency (and the increased battery life associated therewith), the addition of PNCs provides almost limitless scalability.

In addition to self-forming capabilities, the network is also self-healing. If one sensor node fails, the other nodes eliminate that node from use in the ad-hoc routing scheme and continue operation. Thus, loss of a node is not fatal to the network. In applications that have multiple portable network coordinators, if one portable network coordinator fails the other portable network coordinators automatically reconfigure to establish communication with the effected sensor nodes. Thus, loss of a portable network coordinator is also not fatal to the network.

Unlike some conventional systems, sensor nodes 20 communicate with each other only to pass data and information from the sensor nodes 20 to the central processing and control system 40, and to relay commands from the central processing and control system 40 to any sensor node in the network. At no time do the sensor nodes engage in a discussion or exchange data with each other for the purpose of reaching a conclusion of threat detection. The detection of threat and non-threat events is performed independently by each sensor node, with confirmation of a detected threat/non-threat event being performed at the central processing and control system 40. Exemplary embodiments of the particular methods performed by the sensor nodes 20 and the central processing and control system 40 are discussed in more detail below with reference to FIGS. 6-8.

Examples of data and information, which may be transmitted from the sensor nodes 20 to the central processing and control system 40, include credentials required to join the network, notifications of detected events and any other information and/or data specifically requested by the central processing and control system 40.

For example, a new sensor node may transmit certain credentials upon joining the security network. If the node's credentials are accepted, the central processing and control system 40 may assign a unique address to the sensor node and/or instruct the sensor node to communicate on a particular communication channel.

During operation, a sensor node may detect an anomalous event, classify and identify the detected event as a specific threat event, a specific non-threat event or an unidentified event, and report the event to the central processing and control system 40. The sensor node reports the detected event by generating and transmitting an event notification message to the central processing and control system 40. In one embodiment, the event notification message comprises a multi-bit data packet including the identity and credentials of the reporting sensor node, an event classification (e.g., threat, non-threat, unidentified event), an event identification (e.g., cut, climb, rain, etc.) and possibly a data sample. In one embodiment, the event notification message may be passed from node to node in an ad-hoc routing scheme until it reaches the central processing and control system 40. In the embodiments that include portable network coordinators, the event notification message may be passed from node to node in an ad-hoc routing scheme to a portable network coordinator 25 until it reaches the central processing and control system 40. However, sensor node communication is not limited to ad-hoc routing schemes and may be performed in any suitable manner.

In addition to event notification messages, the sensor nodes 20 may transmit any other data or information, which is specifically requested by the central processing and control system 40. For example, the sensor nodes may transmit raw sensor data or a moving average of the raw sensor data to the control system, upon request, for the purpose of configuring one or more sensor nodes for operation, logging sensor data in a historical log file or obtaining additional data for analysis. In some cases, the sensor nodes may also transmit data regarding the health status of the node, such as low battery.

Examples of commands, which may be transmitted from the central processing and control system 40 to the sensor nodes 20, include operation instructions intended for one or more sensor nodes, configuration information intended for one or more sensor nodes and any other commands or requests that the control system sees fit to issue.

Assume, for example, that a group of sensor nodes 20 detect a non-threat event and identify the non-threat event as rain. The sensor nodes responsible for detecting the rain event will separately generate and transmit event notification messages identifying the rain event to the central processing and control system 40. Upon confirming the rain event, the central processing and control system may transmit one or more instructions to the sensor nodes for responding to the rain event. For example, the central processing and control system may request that the sensor nodes stop transmitting event notification messages identifying the confirmed rain event. Although the nodes will, upon request, stop transmitting rain identifying messages to the control system, the nodes will continue to monitor the security network environment for other anomalous events. Ceasing transmission of confirmed non-threat events provides the advantages of reducing communication network traffic and freeing up processing resources of the central processing and control system.

The central processing and control system may also respond to a confirmed non-threat event in another way. As described in more detail below, the central processing and control system may transmit instructions to one or more sensor nodes for changing a sensitivity level of the detection algorithm used by the sensor nodes to identify anomalous events. Changing the sensitivity level may enable the sensor nodes to effectively tune-out a confirmed non-threat event (such as rain), while continuing to monitor the security network for other potentially threatening events. Changing the sensitivity level may also enable the sensor node to increase its ability to identify the detected event.

In addition to operational instructions, the central processing and control system 40 may also transmit configuration information to one or more of the sensor nodes (see, e.g., FIGS. 10-13) and any other commands or requests that the control system sees fit to issue (such as when the control system requests raw sensor data or a moving average of the raw sensor data from the sensor nodes for the purpose of configuring one or more sensor nodes for operation, logging sensor data in a historical log file or obtaining additional data for analysis).

II. Potential Applications for Sensor Nodes

Sensor nodes 20 can be physically located at almost any location that a user wishes to protect. The internal components of the sensor nodes (see, e.g., FIG. 3) are generally housed within a rugged, tamper-resistant, environmentally sealed housing (see, e.g., FIGS. 4A-D), which makes the sensor nodes ideal for both indoor and outdoor applications. The sensor nodes can be physically attached to almost any structure or physical object, including but not limited to, fences, barriers, doors, gates, roadways, bridges, walkways, waterways, storage areas, liquid/gas storage tanks and pipelines, equipment, vehicles, etc. The sensor nodes can even be buried underground for detecting seismic activity, such as movement or activity associated with pedestrians, vehicles or natural phenomenon, or for detecting leaks in an underground storage tank or pipeline. The method of attachment and the type of sensors included within the sensor nodes is typically dictated by the activity a user wishes to monitor.

Sensor node attachment will vary with the application of deployment. For example, a specialized clip may be employed when the sensor nodes are attached to a chain length fence or similar barrier (see, e.g., FIGS. 5A-D). When connected to a vehicle or other planar surface, a specialized bracket (not shown) may be used to attach the node to the surface. Regardless of the mode of attachment, the sensor nodes will be attached in a manner that provides the highest degree of sensor performance, while remaining tamper-resistant. In some cases, the sensor nodes may generate an alarm in the event of being tampered with.

The type of sensors included within the sensor nodes will also vary with applications of deployment. For example, an accelerometer may be included within the sensor nodes when one desires to monitor movement, vibration or free fall within the security network. Other types of sensors may also be included within the sensor nodes. For example, passive infrared sensors can be used for detecting heat or movement at a distance, capacitive sensors can be used to detect the proximity of an intruder to a node, and chemical sensors can be used to indicate a leak in a storage tank or pipeline. Other types of sensors not specifically mentioned herein may also be included within the sensor nodes.

Figure 2:
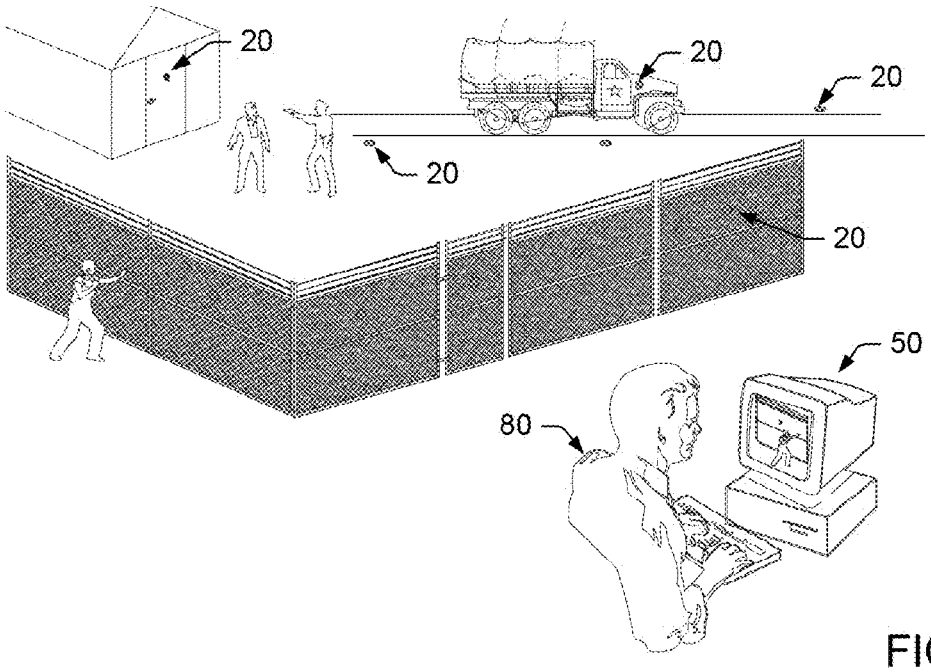
FIG. 2 is an illustration depicting exemplary applications for the plurality of sensor nodes, such as barriers or fences, buildings, roadways and vehicles to name a few.

FIG. 2 is an illustration depicting one manner in which a plurality of sensor nodes 20 may be deployed in a security network. As shown in FIG. 2, the sensor nodes (represented in the drawing by circular disks) may be fixedly attached to a fence for monitoring a perimeter bounded by the fence. In most cases, the sensor nodes may be somewhat evenly spaced around the fence (e.g., every ten feet), although this is not a requirement for operation. In addition to monitoring the perimeter, areas within the perimeter may also be monitored by attaching sensor nodes to one or more buildings, walkways, roadways and/or vehicles, for example.

Unlike some conventional security systems, all sensor nodes deployed within the security network will report to the central processing and control system (40, FIG. 1) for confirmation of detected events and activation of appropriate responses to confirmed events. Response activation may be performed automatically by the central processing and control system, or may be performed manually by a user 80 after notification of a confirmed event is transferred and displayed on a display device of a user interface system 50. Although represented as a personal desktop computer in FIG. 2, the user interface system 50 may additionally or alternatively comprise any suitable computing or communication device, such as a laptop computer, a tablet computer, a personal digital assistant (PDA), a cell phone, a digital pager, or a custom or proprietary console.

III. A General Embodiment of a Sensor Node

Figure 3:
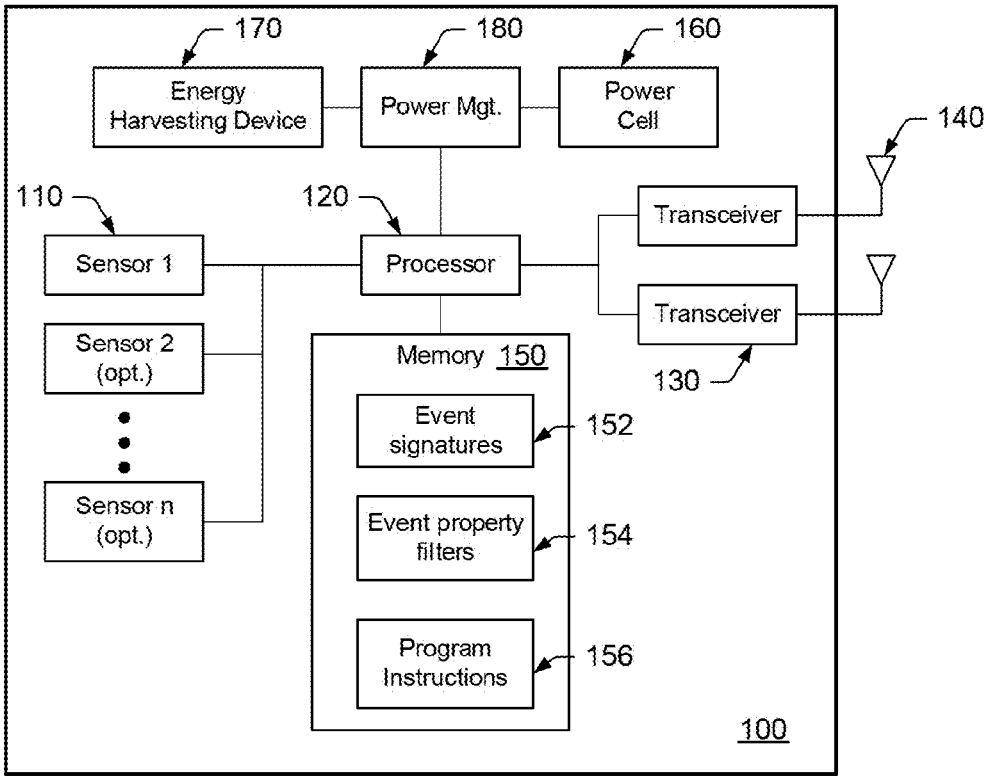
FIG. 3 is a block diagram illustrating an embodiment of a sensor node.

FIG. 3 is a block diagram illustrating one embodiment of a sensor node 100 that may be deployed in the improved security network described herein. As shown in FIG. 3, sensor node 100 includes one or more sensors 110 for acquiring data pertaining to the physical environment surrounding the node. In one embodiment, sensor node 100 may include only one sensor ("Sensor 1"), if the applications for sensor node deployment within the security network can be successfully monitored with a single type of sensor. For example, an accelerometer may be included within sensor node 100 for detecting motion, vibration and/or free fall in each of the applications shown in FIG. 2.

However, sensor node 100 is not limited to having only one sensor ("Sensor 1") and may include one or more additional sensors ("Sensor 2" . . . "Sensor n") in other embodiments of the invention. In most cases, at least one of the additional sensors may comprise a different type of sensor technology than that used for Sensor 1. Following the example embodiment provided above, sensor node 100 may include an accelerometer ("Sensor 1") and at least one additional sensor ("Sensor 2" . . . "Sensor n"), such as a passive infrared sensor for detecting heat or movement at a distance, a capacitive sensor for detecting the proximity of an intruder to a node, and/or a chemical sensor for detecting leaks in a storage tank or pipeline. Other sensors 110 optionally included within sensor node 100 may include, but are not limited to, a radiation detector, an audio sensor, an image sensor, a pressure sensor, a magnetic sensor, a humidity sensor, a biological sensor, a radar sensor, an ultrasonic sensor, a motion sensor, a microwave sensor, a position sensor, a radio frequency sensor and a visible light sensor.

The data acquired by sensor(s) 110 is supplied to a processor or microcontroller 120. As described in more detail below, processor 120 is generally configured to execute a set of program instructions for detecting anomalous events in the acquired sensor data, classifying the detected events as threat events, non-threat events or unidentified events, and generating event notification messages identifying the detected events. The event notification messages may then be transmitted via one or more transceivers 130 and associated antennas 140 to the central processing and control system 40 shown in FIG. 1.

The type of data acquired by the sensor(s) 110 is determined by the type of sensor(s) included within the sensor node 100. For example, an accelerometer is designed to sense seismic activity, such as motion, vibration or free fall. A passive infrared sensor, on the other hand, is designed to detect the presence of heat. The sensor data provided by different sensor technologies could differ, and may be provided in the form of single waveforms, multiple waveforms, particle counts or a simple "go or no go" type response.

Although the type of data acquired by these sensors will differ by design, the data obtained from each sensor during an anomalous event may have a unique pattern or signature, which enables the processor 120 to detect, classify and identify the anomalous events as they occur. In some cases, data from multiple sensor technologies may be combined in the analysis of threat detection.

Figure 6:
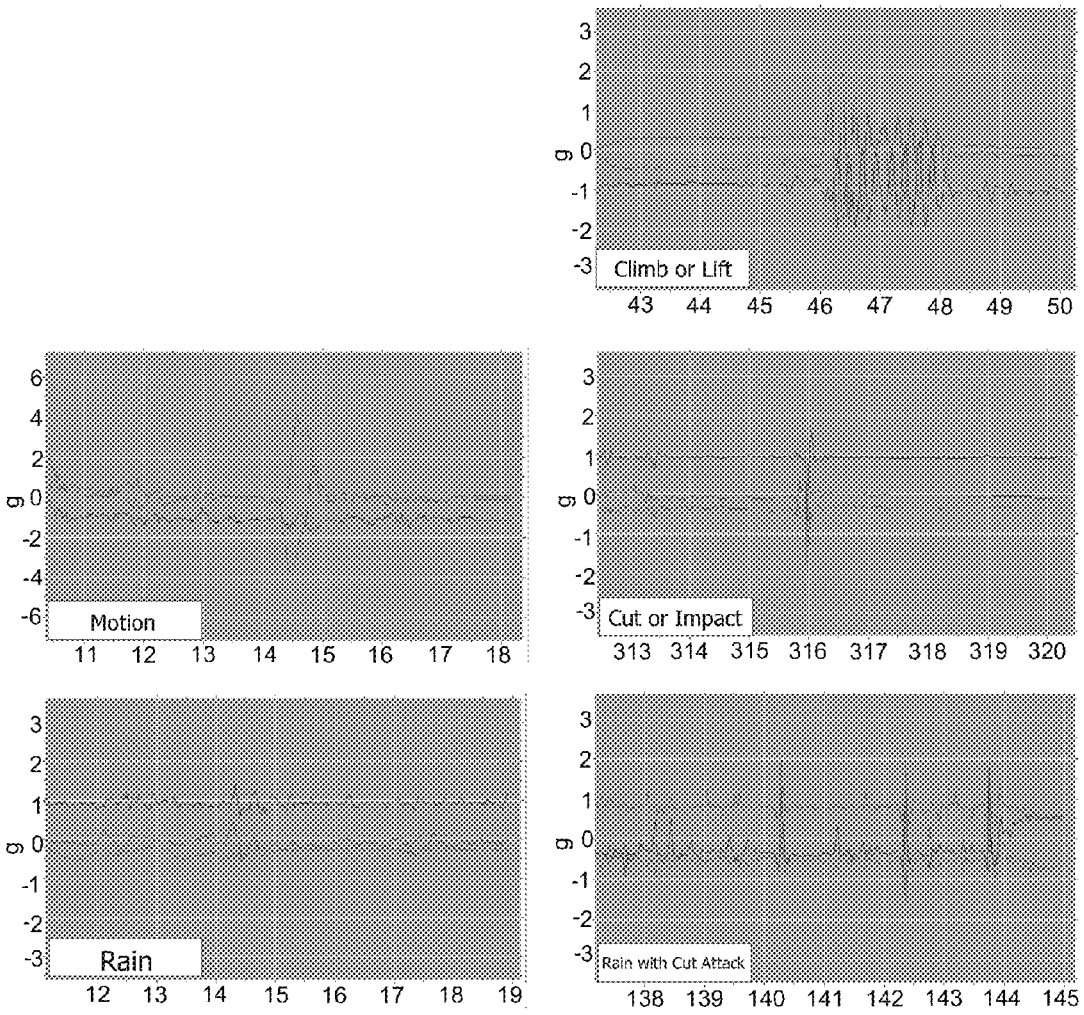
FIG. 6 are graphs showing exemplary event signatures for a variety of different threat and non-threat events.

For example, FIG. 6 illustrates various waveforms that may be acquired by an accelerometer 110 during certain anomalous events. In particular, FIG. 6 illustrates various waveforms acquired by an accelerometer during certain non-threat events (such as "Wind" and "Rain"), during certain threat events (such as a "Climb or Lift" or a "Cut or Impact"), and during a threat event that happens to occur during a non-threat event ("Rain with Cut Attack"). For the purpose of brevity, FIG. 6 illustrates only a small sampling of waveforms representing various threat and non-threat events that may be acquired, for example, by an accelerometer. One skilled in the art would recognize how the data acquired by one or more sensor(s) 110 could be used to detect many different types of events (including a multitude of different threat and non-threat events).

As noted above, the data acquired by sensor 110 during an anomalous event may have a fairly unique pattern or "event signature," which distinctly represents that event. For example, and as shown in FIG. 6, a "Rain" event may be represented by a multitude of low-amplitude disturbances of the sensor node that occur somewhat continuously over a period of time. A "Cut Attack", on the other hand, may be represented by a high amplitude spike of short duration that occurs one or more times during a specified time period. Other anomalous events may also have distinguishing features, which can be used to identify those events.

"Event signatures," such as those shown in FIG. 6, may be stored within the sensor node by the manufacturer of the node or distributor of the security network (e.g., as a default mode), upon activation or installation of a node into a security network (e.g., as a custom mode), or dynamically during operation of the sensor node in the field. The "event signatures" 152 for all known or "previously identified anomalous events" are stored within memory 150, along with a number of "event property filters" 154, which are associated with the known event signatures and define a number of classification parameters that must be met in order to successfully classify a detected event as one of the previously identified anomalous events. As described in more detail below, the event signatures 152 and event property filters 154 are used by processor 120 for detecting, classifying and identifying anomalous events in the security network. The algorithms used by processor 120 for detecting, classifying and identifying anomalous events are embodied in program instructions 156, which are also stored within the memory 150 of sensor nodes 100. These algorithms will be described in more detail below with reference to FIG. 8.

As shown in FIG. 3, sensor node 100 may include at least one wireless transceiver 130 and associated antenna 140 for communicating with the central processing and control system (40, FIG. 1). In one embodiment, the sensor node may include one or more radio frequency (RF) transceivers 130 and associated antennas 140. Examples of suitable antennas may include, but are not limited to, PCB trace, chip, loop, helical, vagi, ¼ wave, dipole, folded dipole and omni-directional antennas.

If multiple RF transceivers are included within the sensor node, the transceivers may each be configured for operating over the same frequency, or alternatively, over two or more substantially different frequency ranges. For example, sensor node 100 may include a first transceiver operating at about 900 MHz for communicating radio frequency information over relatively large distances (e.g., up to about 4 miles) and a second transceiver operating at about 2.4 GHz for communicating over substantially shorter distances (e.g., up to about 300 meters). Including one or more RF transceivers with substantially different operational frequency ranges enables the sensor nodes to switch communication frequencies for the purpose of avoiding interference or network congestion on a particular communication channel. It also provides other advantages. For example, in the event that attempts are made to disable the system by jamming the primary radio frequency, the sensor node can automatically switch to an alternate frequency to recover from the jamming attack. In the event that the central processing and control system requires large amounts of data from the sensor network, all available radios can utilized simultaneously to maximize bandwidth and increase communication efficiency.

Although the sensor nodes have been described herein as including RF transceivers, and specifically, two or more RF transceivers having substantially different operating frequency ranges, the sensor nodes are not limited to any particular number, type or operational range of transceiver. In general, the RF transceivers may operate at a variety wavelengths including, but not limited to, frequencies in the industrial, scientific and medical (ISM) band, government, military band and/or reserved.

In one alternative embodiment, the RF transceivers and antennas shown in FIG. 3 may be replaced with one or more infrared (IR) transceivers and associated optical input/output devices. Alternatively, the sensor nodes may include separate circuitry for supporting RF and IR communications. In another alternative embodiment, one or more of the sensor nodes may include a data interface and input/output port (not shown), instead of a wireless transceiver, for communicating data and information over a wired communication link.

Although wired communication is possible, the sensor nodes 20 and central processing and control system 40 preferably communicate over wireless communication links using one or more wireless communication protocols, such as IEEE 802.15.4, 6LoWPAN, RF4CE, or another custom or proprietary protocol. In one preferred embodiment, the sensor nodes and control system communicate in accordance with the IEEE 802.15.4 standard, which was designed to address the need for a cost-effective and low-power wireless standard optimized for monitoring and control. Features of the IEEE 802.15.4 standard include data rates of 250 kbps, 40 kbps, and 20 kbps, two addressing modes (16-bit short and 64-bit IEEE addressing), support for critical latency devices, CSMA-CA channel access, automatic network establishment by the coordinator, fully handshaked protocol for transfer reliability, and power management to ensure low power consumption. The IEEE 802.15.4 standard provides 16 channels in the 2.4 GHz ISM band, 10 channels in the 915 MHz band and one channel in the 868 MHz band.

In one embodiment, microcontroller/processor 120, memory 150 and RF transceiver(s) 130 may be integrated into a single component, or system-in-package (SIP). In some embodiments, one or more of the sensors 110 may also be included in the SIP. An example of a suitable SIP is the ZigBee® technology provided by manufactures, such as Freescale Semiconductor (P/N MC13213), Atmel (P/N ATmega128RFA1) or Texas Instruments (CC2530). The ZigBee® technology provides an 802.15.4 compliant solution, which combines a variety of different microcontroller units (e.g., 8-bit to 32-bit MCUs) having flexible peripheral and memory combinations (e.g., 4 KB to 128 KB flash memory)

with 802.15.4 compliant RF transceivers and 802.15.4 compliant sensors. Sensor solutions currently available in ZigBee products include acceleration, pressure, proximity and safety and alarm sensors.

In addition to hardware components, the ZigBee® technology includes Media Access Control (MAC) software for supporting peer-to-peer, star and mesh networks. The ZigBee® technology also includes software for AES 128 bit data encryption, decryption and authentication, maintaining the network communication and providing a method for other software programs to interface to the network.

Although SIP products, like ZigBee®, may be preferred for their ease of use, the sensor nodes 100 are not limited to currently available SIPs. In one alternative embodiment, the microcontroller/processor 120, RF transceivers 130 and sensors 110 may be implemented in the circuit in the form of discreet components. For example, the sensor nodes 100 could include separate transceivers 130 that share a common microcontroller 120. Each transceiver 130 could have its own dedicated memory resources (not shown) for storing the data needed to establish and maintain radio communications. The data and program instructions needed for monitoring the security network for threat and non-threat events may be stored within memory 150 for use within microcontroller/processor 120. Memory 150 may comprise random access memory (RAM), read only memory (ROM), flash memory, or any combination thereof.

Sensor nodes 100 may include other components in addition to those mentioned above. For example, and as shown in FIG. 3, sensor nodes 100 may include a battery or other type of power cell 160 for providing power to the internal components of the sensor node and an energy harvesting device (such as a solar panel) 170 for recharging the power cell. A power management circuit 180 may also be included to prevent overcharging of the power cell, and to regulate the amount of power supplied to the node components by the power cell. In some embodiments, the sensor nodes may also be hard wired for power. Other components not specifically mentioned herein may also be included within the sensor nodes.

For ease of manufacturing, the portable network coordinators 25 may include many of the same components included within the network nodes. In one embodiment, for example, a PNC may include one or more processors/microcontrollers 120, one or more transceivers 130 and associated antenna 140, a power cell 160, an energy harvesting device 170 and a power management circuit 180. In some embodiments, sensors 110 may be included within the PNC if it is included within the same SIP as the processor 120 and transceivers 130. Otherwise, sensors 110 may be left out of the PNC as the PNC does not typically perform data acquisition functions. In some embodiments, the PNC components may differ from the sensor node components by including a larger energy harvesting device (e.g., a bigger solar panel) and larger batter size. In addition, the PNC may utilize a directional antenna for more efficiently directing communications to the central processing and control system 40.

IV. An Exemplary Embodiment of a Sensor Node and Clip for Attaching the Sensor Node to a Fence FIGS. 4A-D are 3-dimensional renderings of an exemplary sensor node 290. In particular, FIGS. 4A-D illustrate the embodiment in which the sensor node components described above are distributed and implemented within two separate modules, which are independently enclosed within their own enclosure and assembled to provide a rugged, tamper-resistant, environmentally sealed node.

Figure 4A:
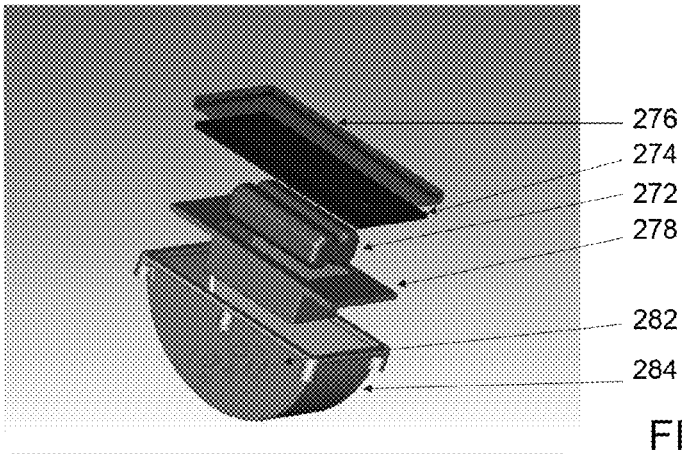
FIGS. 4A-D are 3-dimensional renderings of an exemplary sensor node comprising an auxiliary module and a sensor module enclosed within a rugged, tamper-resistant, environmentally sealed housing.
Figure 4B:
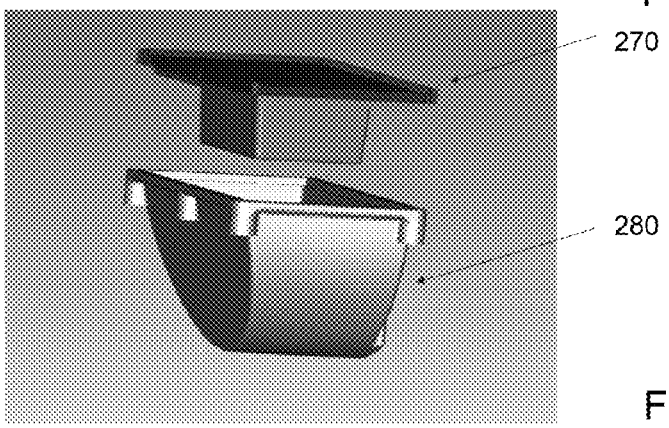
Figure 4C:
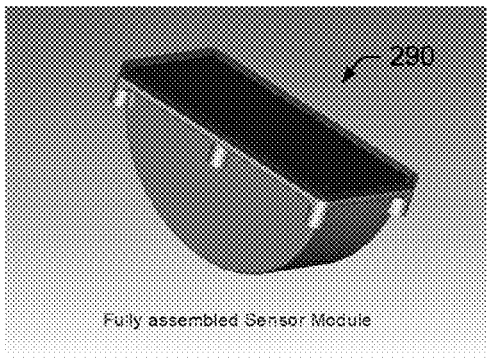
Figure 4D:
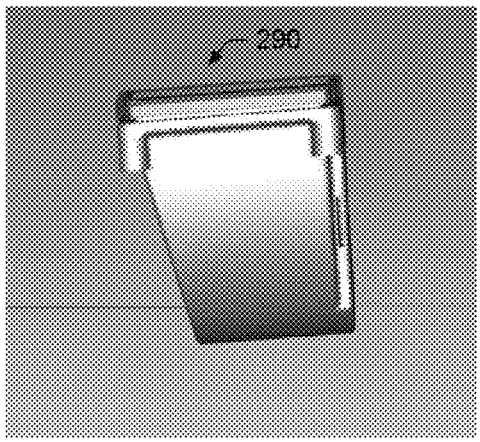

A fully assembled sensor node 260 is illustrated in FIGS. 4C-D. As shown in these figures, the sensor node may have an aerodynamic design, which improves airflow over the enclosure to minimize motion during weather events, which in return, reduces nuisance alarms. Exploded views of the sensor node are illustrated in FIGS. 4A-B. As shown in these figures, the sensor node components may be distributed and implemented within two separate modules. In one embodiment, an auxiliary module 270 may include a power cell with power management circuit 272 and solar panel 274 within an enclosure formed by bottom cover 278 and top cover 276. Sensor module 280 may include the electronic circuitry 282 comprising the sensor(s), processor(s) and transceiver(s) within aerodynamic enclosure 284. The electronic circuitry is fully sealed within the sensor module 280 and protected from the harshest of environments. In addition to providing rugged, tamper-resistant, environmentally sealed housing, the modularity of the sensor node provides flexibility for tailoring the node to a variety of different applications, as well as providing means for easily replacing one or more of the modules.

Figure 5A:
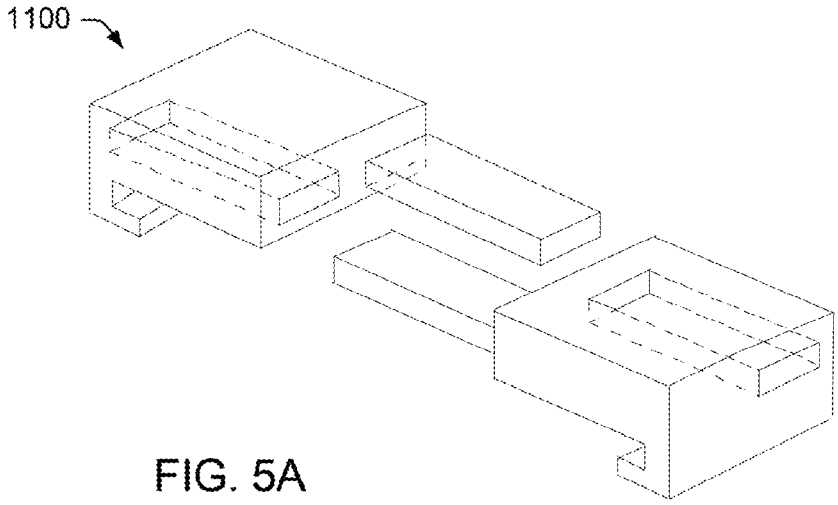
FIG. 5A is a 3-dimensional rendering of an exemplary clip that may be used to attach a sensor node to a chain length fence.
Figure 5B:
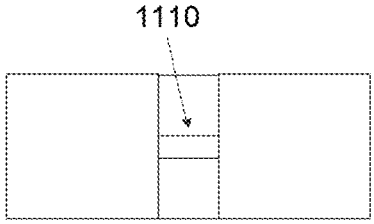
FIGS. 5B and 5C are back and front views, respectively, of the clip shown in FIG. 5A.
Figure 5C:
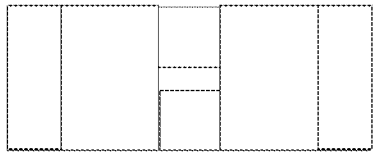
Figure 5D:
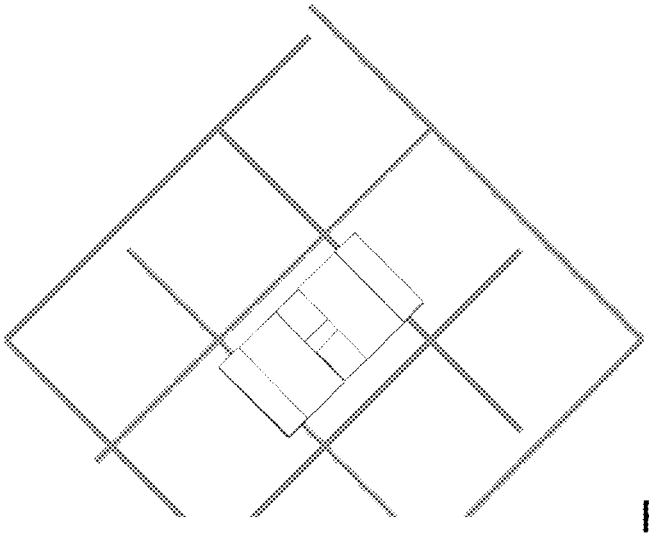
FIG. 5D shows the back side of the clip mounted to a chain length fence.

FIG. 5A is a 3-dimensional rendering of an exemplary clip 1100 that may be used to attach a sensor node to a chain length fence. FIGS. 5B and 5C are back and front views, respectively, of the exemplary clip shown in FIG. 5A, and FIG. 5D shows the back side of the clip mounted to a chain length fence. Although a particular clip is illustrated and described herein, one skilled in the art would understand how alternative means may be used for securely attaching the sensor nodes to a variety of different objects and structures.

As shown in FIG. 5A, a custom clip 1100 may be provided for attaching the sensor nodes to a chain length fence. In one embodiment, the custom clip may be made from a UV rated material, and may comprise two portions which mate together to grip the chain link fence, as shown in FIG. 5D. Once mated, the assembly provides a mounting hole 1110 for attaching the sensor node, as shown in FIG. 5B. Once mated and attached, the sensor node cannot be removed from the fence without detection.

V. A General Embodiment of a Central Processing and Control System

Figure 7:
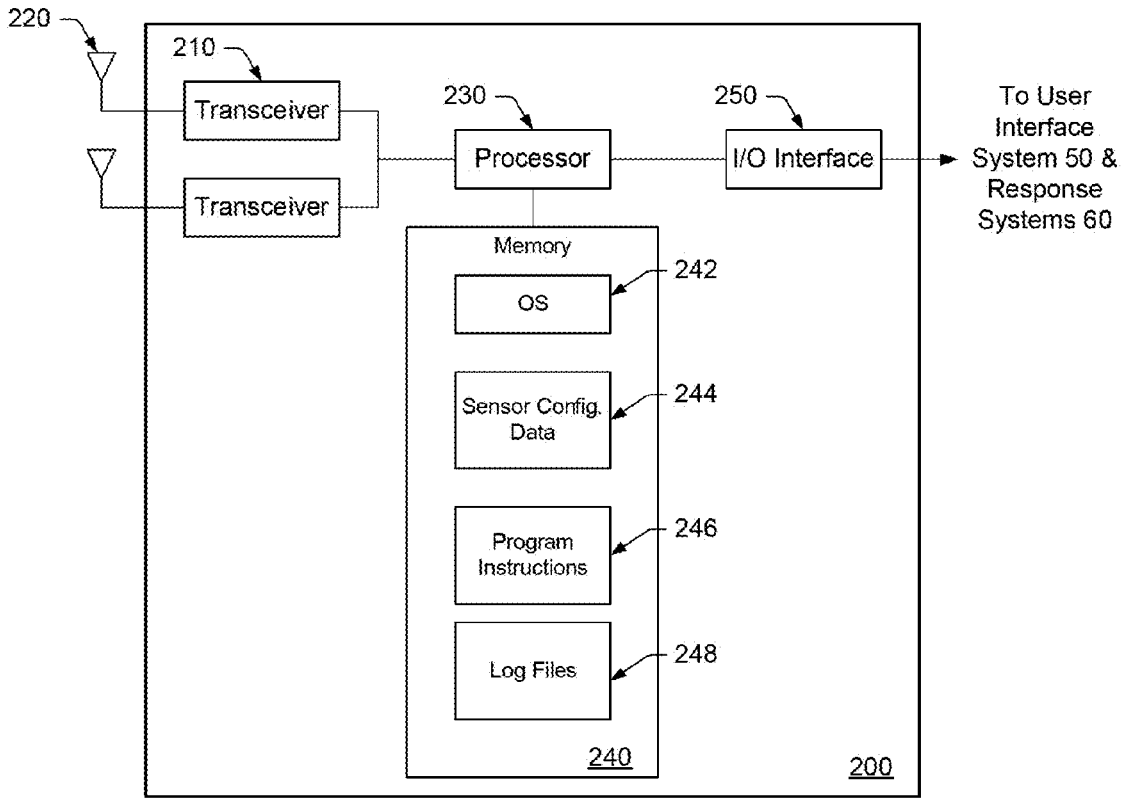
FIG. 7 is a block diagram illustrating an embodiment of a central processing and control system.

FIG. 7 is a block diagram illustrating one embodiment of a central processing and control system 200 included within the improved security network described herein. In general, the central processing and control system 200 may include one or more transceivers 210 and associated antenna 220 (to facilitate wireless communication with sensor nodes 20 and/or portable network coordinators 25), data storage 230 (for storing the operating system, sensor configuration data, program instructions and log files), one or more processors 230 (for executing program instructions and processing data), and an input/output (I/O) interface 250 (for communicating with user interface system 50 and response systems 60). Other components not specifically mentioned herein may also be included within the central processing and control system 200. Only those components, which are essential to the operation of the invention, are shown and described herein for the sake of brevity.

Central processing and control system 200 could be any system or collection of systems having capabilities for executing program instructions, processing data and communicating with sensor nodes 20, portable network coordinators 25, user interface system 50 and response systems 60. The central processing and control system 200 may comprise, or reside within, almost any type of computing device having communication capabilities, such as but not limited to, a personal desktop computer, a laptop computer, a tablet computer, a workstation or a server computer.

Similar to the sensor nodes, central processing and control system 200 may include one or more radio frequency (RF) transceivers 210 and associated antenna 220 to facilitate wireless communication with the sensor nodes. In one embodiment, the central processing and control system 200 may include at least two RF transceivers each configured for operating within the same frequency band, or alternatively, over two substantially different frequency bands. For example, the central processing and control system 200 may include a first transceiver for communicating within a 900 MHz band and a second transceiver for communicating within a 2.4 GHz band. However, the central processing and control system 200 is not limited to any particular number, type or operational range of transceiver. In one alternative embodiment, the central processing and control system 200 may additionally or alternatively comprise other wireless and/or wired communication means.

As noted above, central processing and control system 200 may include one or more processors 230 for executing program instructions and processing data. As described in more detail below, the program instructions executed by processor (s) 230 may generally include instructions for configuring the sensor nodes, confirming the identity of anomalous events detected by the sensor nodes and responding to the anomalous events once confirmation has been made. Exemplary embodiments of algorithms, which are used by processor(s) 230 for confirming the identity of anomalous events detected by the sensor nodes and for responding to the anomalous events once confirmation has been made, are embodied in program instructions 246 stored within data storage 240. These algorithms will be described in more detail below with reference to FIGS. 9-10.

Data storage 240 may comprise hard drives and/or memory for storing operating system 242, sensor configuration data 244, program instructions 246 and log files 248. The operating system 242 may be any suitable operating system such as Windows, Linux, or some other custom or proprietary operating system. In one embodiment, operating system 242 comprises Windows XP.

Sensor configuration data 244 may include various types of data, such as the location of each sensor node 20 in the network 30, including whether or not the sensor node belongs to a "zone" or group of nodes, the type of anomalous events the sensor nodes 20 are configured to detect, and the event property filters defining the classification parameters that a detected event must meet before the identity of a detected event can be confirmed. In one embodiment, each of the sensor nodes 20 may be configured substantially the same, and thus, may have substantially identical sensor configuration data 244.

However, as the sensor nodes 20 may be deployed in network 30 for monitoring a variety of different locations (such as buildings, fences, walkways, roadways, vehicles, etc.), it is more likely that one or more of the sensor nodes may be configured somewhat differently than the other nodes in the network, depending on the location of the one or more sensor nodes. For example, a node attached to an interior door may have a different configuration than nodes attached to a chain link fence. Also, a node attached to a section of chain link fence that has a lot of slack (due, e.g., to a repair) could have a different configuration than nodes attached to sections of chain link fence that are taught. While the possible permutations for sensor node configuration are almost limitless, they are easily accomplished with the security network described herein.

One advantage of the security network described herein is that it allows the sensor nodes to be individually configured for a variety of different locations, environments, scheduled activities and events. After an individual node is configured, the sensor configuration data 244 may be saved and possibly cloned to other nodes, which the user wishes to configure similarly. The sensor nodes may be configured in the field (e.g., by a technician or user upon installing a new sensor node or upon reconfiguring an existing sensor node), or remotely through the user interface system 50 shown generically in FIG. 1. Regardless of where the sensor configuration is performed (e.g., in the field or at the user interface), the sensor configuration data 244 may be stored within data storage 240 of control system 200 and within memory 150 of sensor node 100, so that each has an accurate copy of the sensor configuration data. Embodiments for configuring one or more sensor nodes through the user interface system 50 will be described in more detail below in reference to FIGS. 11-15.

Another advantage of the security network described herein is that it allows the sensor nodes to adapt to changes in their environment. For example, when a non-threat event (such as a weather-related event) is detected by the sensor nodes and confirmed by the central processing and control system 200, the control system 200 may respond to the non-threat event by modifying one or more aspects of the sensor configuration data 244. In particular, the control system 200 may alter the sensitivity level of one or more classification parameters used by the sensor nodes to identify an event. After altering its own sensor configuration data 244, the control system 200 may generate and transmit instructions to one or more of the sensor nodes for changing the sensor configuration data stored therein (e.g., within the event property filters 154). Altering the sensor configuration data may enable the sensor nodes to effectively "tune-out" the non-threat event, thereby increasing the likelihood of detecting other anomalous events, which may otherwise have been masked or obscured by the non-threat event.

Data storage 240 also includes log files 248. In one embodiment, log files 248 includes a historical log all anomalous events detected by the sensor nodes (an "event history log"), as well as a historical log of system performance and diagnostic information (a "system log"). The event history log could include various types of information, such as the date, time and identity of an anomalous event detected by a sensor node, the location where the anomalous event occurred (e.g., the location of the sensor node reporting the anomalous event), the response priority assigned to the anomalous event after the event was confirmed, as well as other data collected by the sensor nodes and reported to the central processing and control system. In some cases, the raw sensor data (and/or a moving average of the raw sensor data) corresponding to the anomalous event may be stored in a database and linked to the event data stored within the event history log for further analysis. As described in more detail below, the raw sensor data may be utilized by the control system 200 for classifying new events, or alternatively, for predicting future events.

Input/output (I/O) interface 250 may be included within the control system 200 for communicating with the user interface system 50 and the response systems 60 shown in FIG. 1. I/O interface 250 may comprise any wired and/or wireless communication interface. For instance, a wired interface may be used when the control system 200 and the user interface 50 are embodied within the same system, or within two separate systems connected together, e.g., via a wired LAN. On the other hand, a wireless communication interface may be used when wireless communication is desired between systems separately comprising the control system 200 and the user interface 50. I/O interface 250 may also connect control system 200 to one or more external devices, such as alarm panels, email, auto dialers, video recorders and other response systems 60. The I/O interface connecting the control system 200 to the response systems 60 may be the same interface, or a different interface than the one used to connect the control system 200 to the user interface 50.

Figure 8:
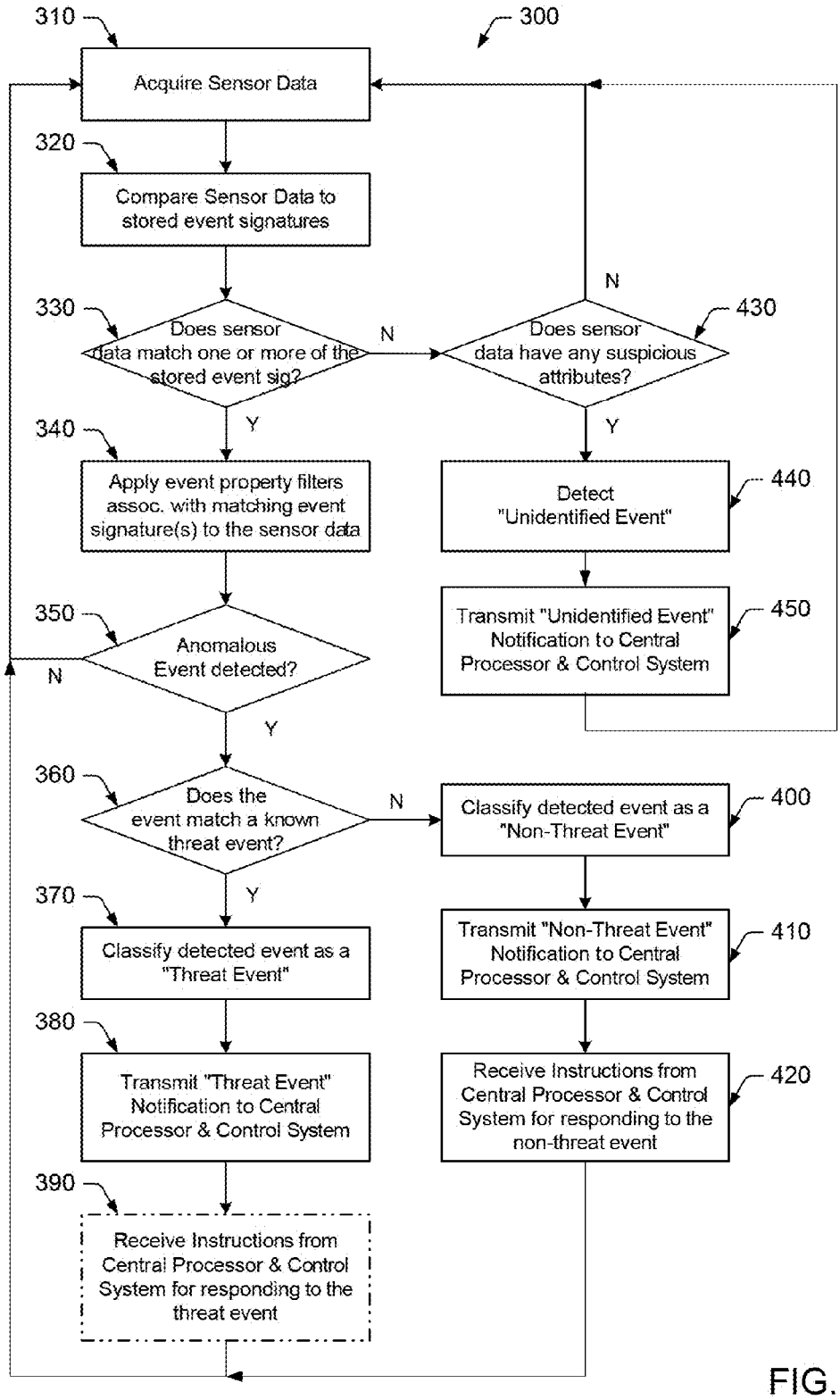
FIG. 8 is a flow chart diagram illustrating an embodiment of a method performed by a sensor node for monitoring sensor data and detecting events.

VI. A General Embodiment of a Method for Detecting Anomalous Events at a Sensor Node FIG. 8 is a flow chart diagram illustrating one embodiment of a method 300 performed by a sensor node for monitoring sensor data and detecting anomalous events. It is noted that while the steps shown in FIG. 8 are described as occurring in a particular order, the method is not specifically limited to the order illustrated in FIG. 8. In some embodiments, one or more of the method steps shown in FIG. 8 may be performed in a different order, or may be performed more than once. The method described herein is intended to comprise all such variations.

As mentioned above, each of the sensor nodes 20 deployed in the network 30 performs the method illustrated in FIG. 8. Upon detecting an anomalous event, a sensor node will generate and transmit an event notification message identifying the detected event to the central processing and control system 40 for confirmation and response. The methods described herein improve upon conventional threat detection methods, e.g., by providing the configurability and adaptability needed to reduce communication network congestion and increase accuracy of threat detection. The methods described herein are generally embodied as program instructions 156 stored within memory 150 of sensor nodes 100.

In one embodiment, method 300 may begin by acquiring data pertaining to the security network environment (in step 310). Specifically, raw sensor data is acquired by the one or more sensors 110 included within the sensor node 100. As noted above, the type of data acquired may generally depend on the type of sensor(s) 110 being used to acquire the data (e.g., an accelerometer, passive IR sensor, capacitive sensor, magnetic sensor, etc.). As such, the acquired sensor data may be represented by a single waveform, multiple waveforms, a particle count or a simple "go or no go" type response.

As data is acquired, the method may detect anomalous events in the sensor data by comparing the raw sensor data (or a moving average of the raw sensor data) to the event signatures of known events stored within memory 150 of sensor node 100 (in step 320). In one embodiment, the sensor node may utilize a pattern recognition algorithm for comparing the acquired sensor data to the known event signatures. The pattern recognition algorithm may compare properties and/or patterns of the acquired sensor data to properties and/or patterns associated within the known event signatures. In some cases, the pattern recognition algorithm may account for variations between the acquired sensor data and the known event signatures by specifying some percentage (e.g., 80%) that the sensor data is required to resemble the known event signature.

The type of analysis performed in comparison step 310 depends on the type of sensor technology being used to acquire the data. For example, when analyzing data obtained from a 3-axis accelerometer, the three (x, y, z) waveforms acquired by the accelerometer could be analyzed independently to observe pulse amplitude, duration, modulation and repetition. These properties could then be compared to similar properties obtained from the known event signatures. In some cases, the known event signatures could be stored within the sensor nodes as raw sensor data, so that pattern recognition can be performed on both the stored data and the acquired data. For computational efficiency, however, it is generally desirable to compute the various properties associated with the known event signatures prior to storage of the known signatures.

If the method determines that the acquired sensor data substantially matches one or more of the stored event signatures (Y branch of step 330), the method will apply event property filters associated with the matching event signature (s) to the acquired sensor data (in step 340). As noted above, a plurality of event property filters may be associated with each of the known event signatures. The event property filters define a number of classification parameters that must be met in order to successfully detect and classify an event as one of the previously identified anomalous events. The event property filters are included within the sensor configuration data 154 stored within memory 150 of sensor nodes 100, as well as the sensor configuration data 244 stored within data storage 240 of control system 200.

The event property filters applied to the data may depend on the sensor technology supplying the data, as well as the matching event signature(s). Exemplary event property filters may include, but are not limited to, the type of data to be used for analysis (e.g., the raw sensor data or a moving average thereof), the portions of the sensor data to be used for analysis (e.g., all of the sensor data may be analyzed, or portions of the data may be ignored to isolate a desired input), a min/max energy threshold that the sensor data must meet to qualify as an event, the number of events that must be detected in order to classify the event, and the time span of the detection window after the first event. These event property filters and others will be described in more detail below in reference to FIG. 13. In general, however, application of the event property filters increases the accuracy with which the method 300 may detect and classify an anomalous event, e.g., by reducing the occurrence of false or nuisance alarms. In some embodiments, one or more event property filters (e.g., a threshold filter) may be applied to the sensor data before the data is compared to the stored event signatures.

If the method determines that the sensor data does not meet the requirements set by the event property filters to qualify as an anomalous event (N branch of step 350), the method returns to step 310 to continue acquiring sensor data for monitoring the security network environment. However, if the sensor data meets the requirements set by the event property filters to qualify as an anomalous event (Y branch of step 350), the method continues to step 360 to determine if the event matches a known threat event or a known non-threat event. The outcome of this step is determined by the matching event signature determined in step 330, as each of the stored event signatures will be associated with a specific, previously classified event. Examples of known threat events include, but are not limited to, cuts, climbs, impacts, lifts, motion, free fall and unauthorized engine running. Examples of known non-threat events include, but are not limited to, weather related events (such as wind, rain, hail, etc.) and other events caused by nature (such as an animal brushing up against a fence, or a bird flying into a protected area).

If the detected event matches a known threat event (Y branch of step 360), the detected event is classified as a threat (in step 370), and an event notification message is generated and transmitted to the central processing and control system (in step 380). The event notification messages identify the particular threat event detected by the method. In one embodiment, the event notification message may be a multi-bit data packet including the identity and credentials of the reporting sensor node, the identity of the detected threat event (e.g., cut, climb, etc.), and possibly a data sample (if requested by the control system). Other status conditions such as pre-alarm data and the health of the sensor node can also be transmitted at the request of the control system. As described in more detail below with reference to FIGS. 9 and 10A, the central processing and control system 200 may receive the event notification message from the sensor node, confirm the identity of the threat event detected by the sensor node, and once confirmed, process the threat event. In some embodiments, the sensor node may receive instructions from the central processing and control system 200 for responding to the threat event (in step 390). For example, the sensor node 100 may receive instructions to send data from all available sensors 110 in the node and/or to increase the rate that data is acquired by the sensors.

If the detected event matches a known non-threat event (N branch of step 360), the detected event is classified as a non-threat (in step 400), and an event notification message is generated and transmitted to the central processing and control system (in step 410). In one embodiment, the event notification message may be a multi-bit data packet including the identity and credentials of the reporting sensor node, the identity of the detected non-threat event (e.g., wind, rain, etc.), and possibly a data sample (if requested by the control system). Other status conditions such as pre-alarm data and the health of the sensor node can also be transmitted at the request of the control system. As described in more detail below with reference to FIGS. 9 and 10B, the central processing and control system 200 may receive the event notification message from the sensor node, confirm the identity of the non-threat event detected by the sensor node, and once confirmed, process the non-threat event. In some embodiments, the sensor node may receive instructions from the central processing and control system for responding to the non-threat event (in step 420). For example, the sensor node 100 may receive instructions to send data from all available sensors 110 in the node and/or to increase the rate that data is acquired by the sensors. Other instructions for responding to the non-threat event are discussed in more detail below.

The manner in which the present invention responds to non-threat events represents another advantage that the present invention provides over conventional security networks and methods of threat detection. For example, conventional security networks and methods may respond to non-threat events (such as weather-related events) by alerting a user to the event and/or by logging the event. However, no additional action is taken. On the contrary, the present invention will often respond to a confirmed non-threat event in at least one of two ways.

First, the central processing and control system may send instructions to one or more of the sensor nodes requesting that the sensor nodes stop broadcasting event notification messages identifying the confirmed non-threat event. During a rain storm, for example, a plurality of the sensor nodes may separately detect and identify the rain event, and then broadcast their alerts to the central processing and control system. If the information sent from the sensor nodes is not regulated, the bandwidth available to the communications network could easily be consumed by a plurality of sensor nodes repeatedly transmitting the same rain identifying messages to the central processing and control system. By providing the central processing and control system with the capability to acknowledge the rain alert from the sensor nodes, and then instruct the sensor nodes to cease transmission of the rain identifying messages, the present invention advantageously reduces network congestion and frees up valuable processing resources of the central processing and control system. It is important to emphasize, however, that while the instructions sent to the sensor nodes may cause the sensor nodes to stop broadcasting rain identifying messages, the sensor nodes will continue to acquire data for detecting and identifying other anomalous events. If a sensor node detects an anomalous event, other than the confirmed rain event, the sensor node will transmit that information to the central processing and control system.

In addition or alternatively, the central processing and control system may send instructions to one or more of the sensor nodes for adapting the processing algorithms used therein to changes in the environment. Assume, again, that a plurality of sensor nodes determine that it is raining and transmit rain identifying messages to the central processing and control system. After confirming the identity of the detected rain event and alerting a user to the confirmed event, the central processing and control system may respond to the rain event by sending instructions to the sensor nodes for changing a sensitively level of at least one classification parameter used by the sensor nodes for detecting and identifying anomalous events. For example, the sensor nodes may be instructed to raise the event threshold level to compensate for the increased noise detected by the sensors due to the rain event. In most cases, the sensitivity levels may be changed automatically by the central processing and control system; however, a provision for manual override is generally provided via the user interface system. Regardless of how the sensitivity levels are changed, changing the sensitivity levels may enable the sensor nodes to substantially ignore or "tune-out" the rain event, so that the sensor nodes may continue to monitor the environment for other anomalous events.

If the method determines that the acquired sensor data does not match one of the stored event signatures (N branch of step 330), the method may determine if the sensor data has any suspicious attributes (in step 430). As described in more detail with reference to FIGS. 8C and 8D, suspicious attributes in the sensor data may lead the central processing and control system to identify new events (i.e., previously unidentified threat and non-threat events) or predict possible future threat events. If suspicious attributes are detected in the sensor data (Y branch of step 430), the sensor data is determined to include an unidentified event (in step 440). Upon detecting an unidentified event, the method generates and transmits an event notification message to the central processing and control system. In some cases, the raw sensor data containing the unidentified event may also be transmitted to the control system for further analysis. If no suspicious attributes are detected in the sensor data (N branch of step 430), the method returns to step 310 to continue acquiring sensor data for monitoring the security network environment.

VII. A General Embodiment of Methods Performed by the Central Processing and Control System for Responding to Event Notification Messages Received from One or More Sensor Node(s)

Figure 9:
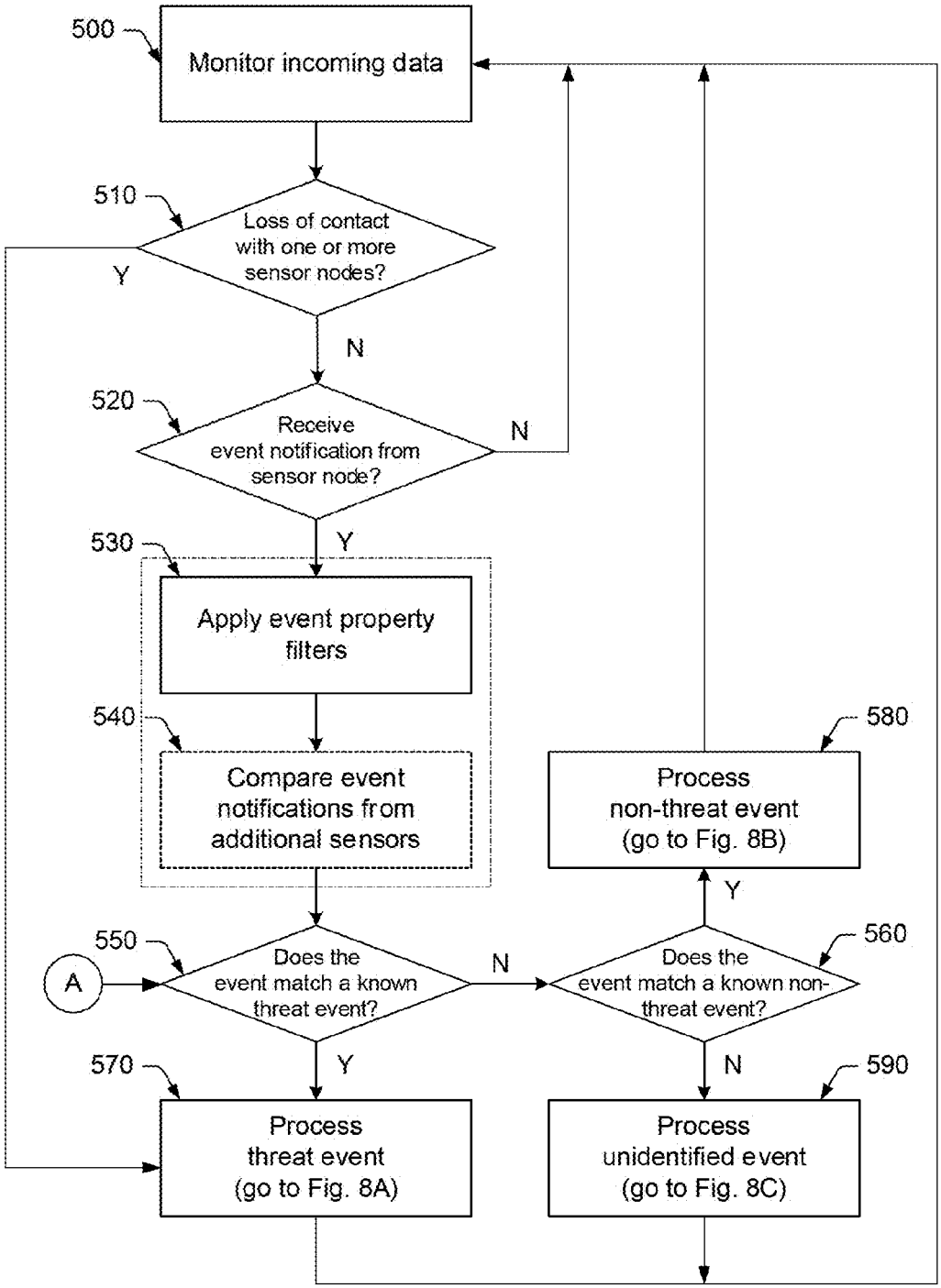
FIG. 9 is a flow chart diagram illustrating an embodiment of a method performed by the central processing and control system for responding to event notifications received from the sensor nodes.

FIG. 9 is a flow chart diagram illustrating one embodiment of a method performed by the central processing and control system for responding to an event notification message received from a sensor node. Exemplary methods for responding to threat events, non-threats and unidentified events are respectively illustrated in FIGS. 10A, 10B and 10C. The flow chart diagram shown in FIG. 10D illustrates one manner in which the central processing and control system may analyze logged data for the purpose of detecting new events, predicting potential future threat events or detecting sensor node malfunctions.

It is noted that while the method steps shown in FIG. 9 and the method steps shown in FIGS. 10A-D are described as occurring in a particular order, the methods described herein are not strictly limited to the specific order illustrated in the figures. In some embodiments, one or more of the method steps shown in FIG. 9 and/or in FIGS. 10A-D may be performed in a different order, or may be performed more than once. The methods described herein are intended to comprise all such variations.

In general, the method shown in FIG. 9 may begin by monitoring the data transmitted to the central processing and control system by the sensor nodes (in step 500). Next, the method may determine if the control system is in contact with all sensor nodes (in step 510). For example, the method may recognize that the control system has not received data from a sensor node for a specified period of time, a sensor node will not respond to requests sent from the control system, or transmissions from a sensor node have been prematurely terminated. If contact with a sensor node is lost (Y branch of step 510), the method may proceed directly to step 570 for processing a potential threat event, as loss of contact may indicate that an intruder has tampered with or destroyed the node. Otherwise, the method may proceed to step 520 for determining if an event notification message has been received from a sensor node.

If an event notification message is received from a sensor node (Y branch of step 520), the method may confirm the identity of the detected event by applying one or more event property filters to the received data (in step 530). In some cases, the central processing and control system may request raw sensor data to be sent from the sensor node, e.g., if the processing algorithm calls for the data to perform some specific algorithm on the data, or if the operator of the user interface has a need to see or record the raw data. In most cases, however, the event property filters are applied to the event notification messages which, as noted above, may be transmitted from the sensor nodes as a multi-bit packet containing the identity of an event, a threat level, and other status conditions.

The event property filters applied by the central processing and control system (in step 530) may be the same as, or different than, those applied by the sensor node. An activity schedule is one example of an event property filter, which is generally applied only by the control system. Activity schedules may be programmed into the control system software or acquired by monitoring the security network over time. The activity schedules could be used for detecting events, which occur at unusual or unauthorized times. For example, it may be desirable to monitor the opening and closing of a particular gate or door only after hours, especially if the gate or door is in frequent use during business hours, as this would generate an overabundance of nuisance alarms. By setting a schedule for monitoring the gate or door, the method described herein is able to detect events that occur outside of authorized times, thereby reducing the number of nuisance alarms generated by the method. Other examples of activity schedules include specifying authorized times during which a vehicle engine may be started, or times in which property or equipment may be moved. An exemplary embodiment for programming one or more activity schedules into the control system will be described in more detail below with reference to FIG. 18.

In some embodiments, the method may also compare event notification messages received from additional sensor nodes (in step 540) to confirm the identity of the detected event. For example, if the control system receives an event notification message indicating rain, the control system may look to see if other sensor nodes are transmitting similar rain identifying messages. As rain is not likely to be an isolated event, the control system may confirm the rain event only if multiple sensor nodes are detecting rain. If none of the other sensors are detecting rain, the control system may suspect suspicious activity. At this point, the method may proceed to the methods shown in FIGS. 10C and 10D for analyzing the suspicious activity.

Once the identity of the detected event is confirmed (in steps 530 and/or 540), the method determines whether the confirmed event matches a known threat event (in step 550) or a known non-threat event (in step 560). If the confirmed event matches a known threat event (Y branch of step 550), the method proceeds to FIG. 10A for processing the threat event (in step 570). If the confirmed event matches a known non-threat event (Y branch of step 560), the method proceeds to FIG. 10B for processing the non-threat event (in step 580). If the confirmed event does not match any of the known events (N branch of step 560), the method proceeds to FIG. 10C for processing an unidentified event (in step 590). Concurrent with said processing steps, the method continues to monitor incoming data from the sensor nodes (in step 510).

Figure 10A:
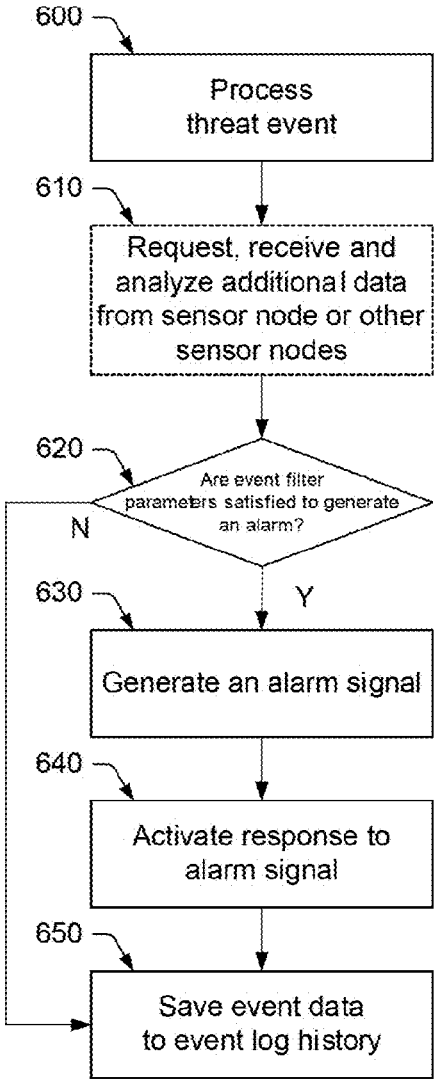
FIG. 10A is a flow chart diagram illustrating an embodiment of a method performed by the central processing and control system for responding to a confirmed threat event.

FIG. 10A is a flow chart diagram illustrating one embodiment of a method 600 performed by the central processing and control system for processing and responding to a threat event. In some embodiments, the method may process a threat event by requesting, receiving and analyzing additional data from the sensor node that originally identified the threat, or from other nodes in the network (in step 610). The step of requesting additional data is optional, however, and may only be performed if additional analysis is needed to confirm the event. For example, the request for additional data may be unnecessary if the central processing and control system is able to positively confirm the identity of a threat event in steps 520-550 of FIG. 9.

However, lets consider the case in which the central processing and control system loses contact with a sensor node (in step 510 of FIG. 9). When a loss of contact occurs, the method initially assumes that the loss of contact is due to a threat or potential threat, and processes the loss of contact according to the steps shown in FIG. 10A. First, the method requests additional data (in step 610 of FIG. 10A) either from the "lost" sensor node and/or from other nodes in the network. For example, if the control system was receiving data from an accelerometer within a sensor node, and all of a sudden stopped receiving that data, the method may request data to be sent from another sensor (such as a passive IR sensor) included within that node. If the control system receives the requested data, it may determine that the accelerometer is faulty. On the other hand, if no data is received or if the control system is unable to communicate with the sensor node, the control system may determine that the node is being tampered with.

After optional step 610, the method may determine if the event property filter parameters are satisfied to generate an alarm signal (in step 620). If the event property filter parameters are not satisfied (N branch of step 620), data pertaining to the event may be logged for further analysis (in step 650), as this may indicate a potential new event, a future event or a node malfunction. If the event property filter parameters are satisfied (Y branch of step 620), the method may generate an alarm signal (in step 630), activate a response to the alarm signal (in step 640) and save the event data in the event history log file (in step 650).

The method may respond to an alarm signal (step 640) in a variety of ways. At the very least, the method will forward the alarm signal to the user interface system for displaying the alarm and alerting a user of the security system to the confirmed threat event. The user would then have the option of requesting additional details for further analysis or documentation of the event, changing various sensor configuration parameters or responding to the threat event by manual activation of one or more response systems. In some embodiments, the method may automatically activate one or more response systems based on a threat level or priority setting, which was previously specified for that event. However, even if an alarm response is activated automatically, the user will still have the option of manually overriding the automatic response through the user interface.

Figure 10B:
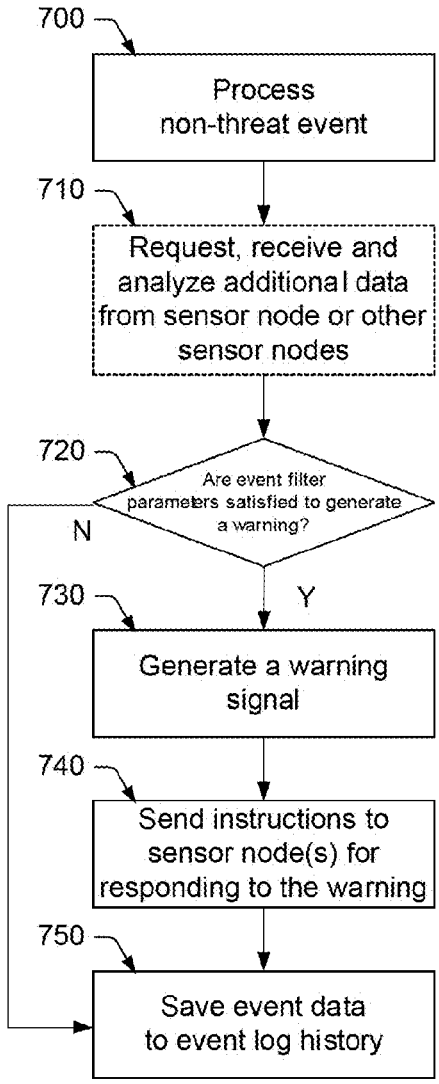
FIG. 10B is a flow chart diagram illustrating an embodiment of a method performed by the central processing and control system for responding to a confirmed non-threat event.

FIG. 10B is a flow chart diagram illustrating one embodiment of a method 700 performed by the central processing and control system for responding to a non-threat event. The methods shown in FIGS. 10A and 10B are similar, in that they both begin with the optional step of requesting, receiving and analyzing additional data from the sensor node, or from nodes in the network (in step 710). For example, the control system may request a sensor node to send data from all available sensors in the node and/or to increase the rate that data is acquired by the sensors. Instead of an alarm, however, the method shown in FIG. 10B may determine if event property filter parameters are satisfied to generate a warning signal (in step 720). If the event property filter parameters are not satisfied (N branch of step 720), data pertaining to the event may be logged for further analysis (in step 750), as this may indicate a potential new event, a future event or a node malfunction. If the event property filter parameters are satisfied (Y branch of step 720), the method may generate a warning signal (in step 730), send instructions to one or more sensor nodes for responding to the warning signal (in step 740) and save the event data in the event history log file (in step 750).

The method may respond to a warning signal (step 740) in a variety of ways. For example, the method may send instructions to one or more of the sensor nodes requesting that the sensor nodes stop broadcasting event notification messages identifying the confirmed non-threat event. As noted above, instructing the sensor nodes to cease transmission of non-threat event notification messages advantageously reduces network congestion and frees up valuable processing resources of the central processing and control system. In addition or alternatively, the method may send instructions to one or more of the sensor nodes for adapting the processing algorithms used therein to changes in the environment. This may enable the sensor nodes to substantially ignore or "tune-out" confirmed non-threat events, so that the sensor nodes may continue to monitor the security network environment for other anomalous events, which otherwise may have been masked by the non-threat event.

Figure 10C:
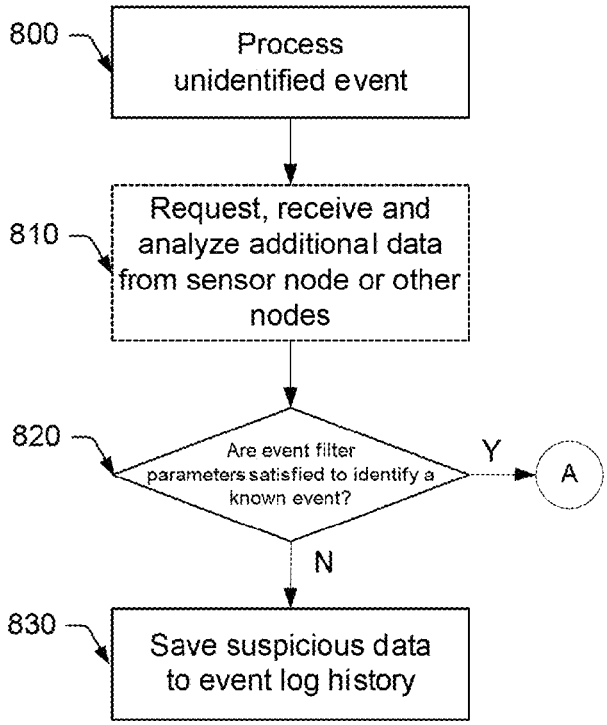
FIG. 10C is a flow chart diagram illustrating an embodiment of a method performed by the central processing and control system for responding to a confirmed unidentified event.
Figure 10D:
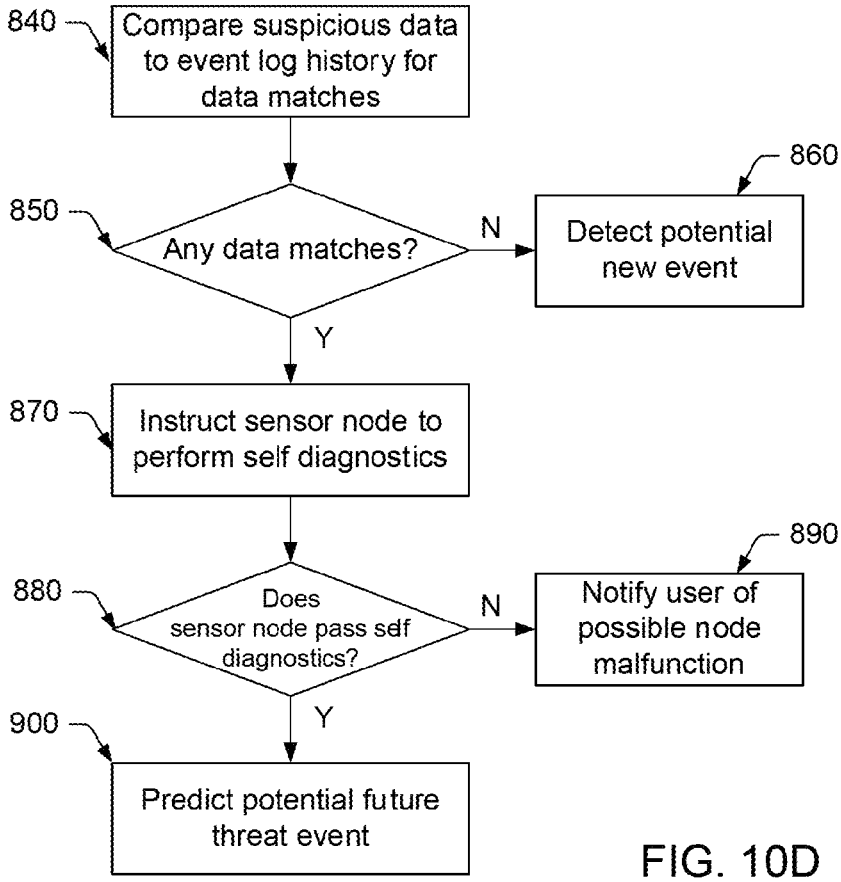
FIG. 10D is a flow chart diagram illustrating an embodiment of a method performed by the central processing and control system for analyzing logged data for the purpose of detecting new events, predicting potential future threat events or detecting sensor node malfunctions.

FIG. 10C is a flow chart diagram illustrating an embodiment of a method 800 performed by the central processing and control system for responding to an unidentified event. Unidentified events may arise from a variety of situations. For example, a sensor node may detect an unidentified event when an anomalous event is determined to have suspicious attributes, but does not match any of the known event signatures stored within the sensor node (as shown in steps 330 and 430 of FIG. 8). The central processing and control system may also detect unidentified events. For example, the control system may receive an event notification message from a sensor node identifying a potential threat event or a potential non-threat event (in step 520 of FIG. 9). However, after applying the appropriate event property filters (in step 530) and possibly comparing event notification messages from other sensors or sensor nodes (in step 540), the control system may fail to confirm the identity of the threat or non-threat event detected by the sensor node. If this occurs, the control system may label the event as "unidentified." Regardless of how the unidentified event arises, the control system processes unidentified events in accordance with the method steps set forth below.

As in previous methods, the method shown in FIG. 10C begins with an optional step of requesting, receiving and analyzing additional data from the sensor node, or from nodes in the network (in step 810). If upon analyzing the additional data, the method determines that event property filters are now satisfied to identify a known event (Y branch of step 820), the method proceeds to step 550 of FIG. 9 for identifying the event as a known threat event or a known non-threat event. If event property filters are still not satisfied for identifying an event, the method saves the suspicious data in the event history log file (in step 830) for further analysis.

FIG. 10D is a flow chart diagram illustrating one embodiment of a method performed by the central processing and control system for comparing suspicious data to logged data for the purpose of detecting new events, predicting potential future threat events or detecting sensor node malfunctions. In some embodiments, the method steps shown in FIG. 10D for comparing suspicious data to logged data may be performed immediately after step 830 of FIG. 10C. In other embodiments, the suspicious data may be compared to the logged data at a later time and/or in response to a request from a user of the security system. As such, the methods shown in FIGS. 10C and 10D are illustrated as possibly two distinct methods performed at two separate times. However, one skilled in the art would understand how the methods shown in FIGS. 10C and 10D could be combined and performed at substantially the same time.

As shown in FIG. 10D, the method may begin (or continue) by comparing suspicious data (which was logged in step 830) to the event history log file (in step 840). As indicated above, the event history log file will include a historical listing of all threat and non-threat events confirmed by the control system, as well as any unidentified events which could not be confirmed and have yet to be identified. For each confirmed anomalous event, the event history log file may include information, such as the date, time and identity of the confirmed anomalous event, the location where the event occurred (e.g., the location of the sensor node reporting the anomalous event), the response priority assigned to the anomalous event after the event was confirmed, as well as other data collected by the sensor nodes and reported to the central processing and control system. In some cases, the raw sensor data (and/or a moving average of the raw sensor data) corresponding to the anomalous event may also be stored within a database and linked with the event data stored within the event history log file. The suspicious data is compared to this information to determine if any data matches exist.

If no matches are found (N branch of step 850), the method may detect a potentially new threat or non-threat event (in step 860). A "new" event is one which has not yet been programmed into the system by storing the appropriate event signatures and event property filters associated with that event. If a potentially new event is detected (in step 860), the method may respond by alerting a user to the potentially new event so that the user may investigate the new event. Alternatively, the method may respond to the new event by automatically storing the appropriate event signatures and event property filters, which will be needed to identify the new event the next time it occurs.

If a match is found (Y branch of step 850), the method may instruct the sensor node supplying the suspicious data to run a self diagnostic test (in step 870) to determine if the suspicious data is due to a node malfunction or a potential future threat event. If the sensor node fails the self diagnostic test (N branch of step 880), the method may notify the user of a possible node malfunction (in step 890). However, if the sensor node is functioning properly (Y branch of step 880), the method may predict the possibility of a future threat event (in step 895).

Intruders often test security systems prior to conducting an attack. For example, an intruder may plan and prepare for an upcoming attack by attempting to gain the information necessary to penetrate a facility's defenses. The intruder will likely survey a protected area to assess vulnerabilities, and in some cases, may intentionally trigger the security system by varying degrees to observe the response. This process may be repeated over several days, typically within areas that the intruder feels comfortable conducting the tests while eluding detection. The methods described herein are able to detect these type of events, even if they do not possess sufficient requirements to immediately generate an alarm.

For example, suspicious events that do not meet the requirements of a known threat event (such as a cut attack, climb, lift, etc.) will be logged (in step 830 of FIG. 10C) and compared to the event history log file (in step 840 of FIG. 10D). If similar events happen to occur, e.g., at the same time and/or within the same areas of the network, the method may recognize a pattern in time and/or location of the occurrences, and may send a warning signal to the user interface to alert the user to suspicious activity. In this manner, the methods described herein can actually predict the possibility of a future threat event. This represents a significant advantage over conventional methods of threat detection, which do not provide prediction capabilities.

VIII. A General Embodiment of a User Interface System

Figure 11:
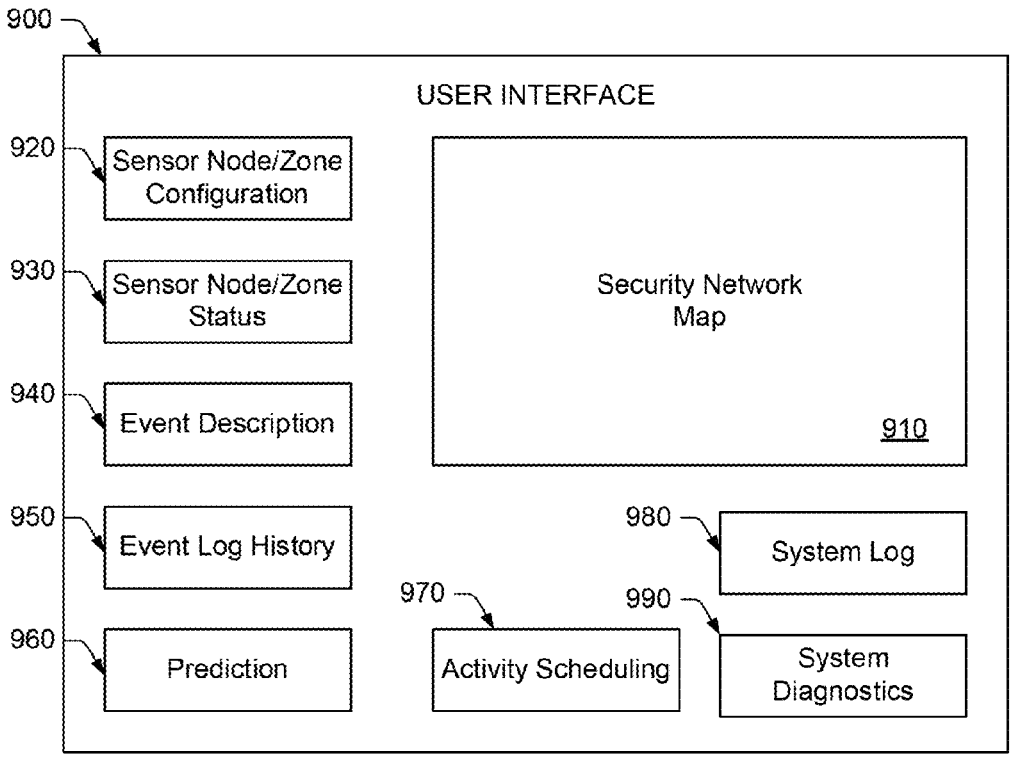
FIG. 11 is a block diagram illustrating an embodiment of a user interface.
Figure 12:
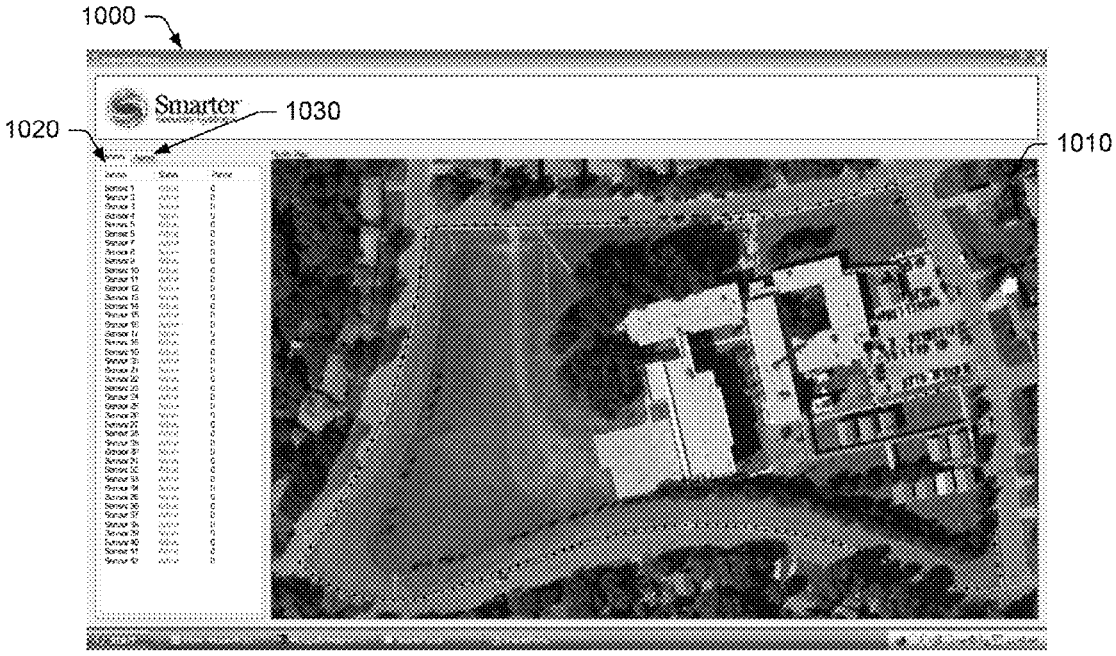
FIG. 12 is a screen shot of an exemplary user interface displaying an aerial map of a security network, arrangement of the sensor nodes in that network, as well as the status and alarm count associated with those nodes.

FIG. 11 is a block diagram illustrating one embodiment of a user interface system 900 that may be included within the improved security network described herein. In general, the user interface system 900 communicates with the central processing and control system 200 for displaying details about the security network and for receiving input from a user of the security network to configure the security network and respond to events. In some cases, the user interface system 900 and the central processing and control system 200 may reside within the same machine. In other cases, the user interface system 900 and the central processing and control system 200 may be located within two or more separate machines connected, e.g., via a wired or wireless communication network.

User interface system 900 may comprise, or reside within, almost any type of communication or computing device having graphical display capabilities, such as but not limited to, a personal desktop computer, a laptop computer, a tablet computer, a workstation, or a handheld device. In a preferred embodiment, however, the user interface system 900 provides a graphical user interface (GUI) for monitoring and controlling the security network. Exemplary GUI components are shown in the block diagram of FIG. 11.

As shown in FIG. 11, the user interface system 900 may include a security network map 910 for displaying the location and status of each of the sensor nodes included within the security network. In one embodiment, the security network map 910 may include an aerial image of the security network with the location and status of the sensor nodes superimposed on the image. The aerial image may be a static image (e.g., a photograph that a facility owner has on file, or a photograph taken specifically for this purpose) or a dynamic, possibly real-time image of the security network (e.g., a satellite image of the security network obtained from the Internet). However, the security network map 910 is not limited to aerial images, and may additionally or alternatively comprise other means for displaying the location and status of the sensor nodes. In one example, the security network map 910 may include a graphical diagram of sensor node placement and status.

In addition to security network map 910, user interface system 900 may include various display and/or configuration modules, such as sensor node/zone configuration module 920, sensor node/zone status module 930, event description module 940, event history log file module 950, prediction module 960, activity scheduling module 970, system log file module 980, and system diagnostic module 990. Each of these modules will be described in more detail below. Other modules not specifically mentioned herein may also be included.

In some embodiments, the sensor nodes may comprise default configuration data (e.g., default event signatures and event property filters) for a variety of different threat and non-threat events. However, the default configuration data may not be suitable for all applications, and some users may wish to supplement or replace the default configuration data with data customized for their needs. Sensor node configuration module 920 provides the user with the ability to customize the sensor configuration data stored within the sensor nodes to suit the user's needs. The sensor node configuration module 920 also enables the user to update the sensor configuration data, e.g., to reflect changes in the security network environment, change node sensitivity, or as the user sees fit. The sensor nodes may be configured and updated individually, or multiple nodes may be grouped together in a zone and configured similarly.

In some embodiments, sensor node configuration module 920 may be used to configure one or more sensor nodes upon installation or activation of the sensor nodes. The sensor nodes are generally configured by training the nodes to detect a plurality of threat and non-threat events. For example, after installing and activating a sensor node, the user could select a training mode to teach the node how to detect various events. Once in training mode, the user could perform a series of exercises to simulate a desired event and confirm that the node can recognize and correctly identify the event. If the node is able to correctly identify the event, an option is provided to replace the default sensor configuration data with the field tested data (i.e., the simulated event signatures and event property filters obtained in the training mode).

In some embodiments, the sensor configuration module 920 may also enable the user to update the sensor configuration data stored within one or more sensor nodes. This is achieved, in most cases, by changing the sensitivity level of one or more classification parameters included within the event property filters. In some cases, however, the sensor configuration data may be updated by adding new event signatures and event property filters to reflect new events.

Sensor node/zone status module 930 displays the current state of the security network by displaying the current status of each sensor node/zone, as well as the number of alarm/warning signals generated for each sensor node/zone. In one embodiment, the status may be displayed as Active, Inactive, Configure, Warning, Alarm or Node Health Status. An Active status means that the sensor node is currently active and in communication with the central processing and control system. An Inactive status means that the sensor node is offline and/or not in communication with the central processing and control system. A Configure status is displayed whenever the sensor configuration data for a sensor node or zone is being updated. A Warning status is displayed for sensor nodes detecting non-threat events, and an Alarm status is displayed for sensor nodes detecting threat events. The Node Health status means that the sensor node has detected an operation outside it's specified parameters, such as low battery charge or weak RF signal strength. The number of alarm/warning signals generated by each sensor node during a monitoring period may also be displayed in the status module 930.

Event description module 940 provides basic details about detected threat and non-threat events, such as the type of event, the location of the event and the approximate threat level. For instance, the event description module may specify that a perimeter cut was detected at sensor 119 necessitating the generation of an alarm signal. Other details may also be provided in the event description module.

Event history log file module 950 displays a historical listing of the event data obtained from one or more of the sensor nodes. As noted above, the event history log file may include various types of information, such as the date, time and identity of an anomalous event detected by a sensor node, the location where the anomalous event occurred (e.g., the location of the sensor node reporting the anomalous event), the response priority assigned to the anomalous event after the event was confirmed, as well as other data collected by the sensor node and reported to the central processing and control system. In some cases, the raw sensor data (and/or a moving average of the raw sensor data) corresponding to the anomalous event may be accessed from the database links included in the event history log and displayed, e.g., in the sensor node/zone status module 940.

Prediction module 960 may be configured to display trends or patterns in the historical data, which may be used to predict potential future threat events. In one embodiment, the prediction module may include a graphical display of all suspicious data collected by the sensor nodes, so that a user of the security system may recognize patterns or trends in the data that indicate the likelihood of an upcoming attack. For example, a user may predict an upcoming attack if a number of low-level disturbances repeatedly occur in the same location, and at roughly the same time, over a number of days or weeks. In addition to displaying suspicious data in a graphical format, the prediction module 960 may also run algorithms for predicting the type of attack most likely to occur, and may also calculate a probability of attack.

Activity scheduling module 970 enables the user of the security system to define times when certain actions are allowed or prohibited. For example, the activity scheduling module enables the user to schedule times for monitoring the opening/closing of doors or gates, starting vehicle engines or allowing motion within an area. As noted above, activity schedules may be programmed into the control system software (through activity scheduling module 970) or acquired by monitoring the security network over time. Once set, activity schedules can be used for detecting events, which occur at unusual or unauthorized times.

System log file module 980 may include a textual display of activity from the user interface system, central processing and control system, communication network and sensor. The system log file records all activity from each segment of the overall system including the user interface (e.g., user log in and out time and history of actions performed by each user), the central processing and control system (e.g., alarm event details, non-threat event details, diagnostic reports, times of door/gate opening or closing, arrival/departure of vehicle, etc.), the communication network (e.g., RF channel selection modifications, data routing through the network and available bandwidth usage), and the sensor node (e.g., events reported to the central processor, health status and diagnostic reports). These detailed records give the system the means to learn schedules of normal activity, to detect patterns of suspicious behavior and to anticipate potential component failure.

System diagnostic module 990 may be used to report the health of the system. For example, system diagnostics may be scheduled to run at specific times and intervals, or the control system may initiate diagnostics for a particular node or nodes that either report a health status issue or meet some requirements to justify performance testing. Lets assume, for example, that all but one of the sensor nodes in the network are detecting and reporting a rain event. If this occurs, the system diagnostic module 990 may be initiated by the user or automatically by the control system 200 to determine if the sensor if faulty. If the diagnostic module 990 successfully isolates a fault in the system, the system would notify the user by displaying the node identity, location and type of malfunction.

IX. An Exemplary Embodiment of a User Interface System

An exemplary embodiment of the user interface system is illustrated in FIGS. 12-18. In particular, FIGS. 12-18 provide screen shots of various graphical user interface (GUI) windows that may be displayed to the user by the user interface system 900 shown generically in FIG. 11. It is noted, however, that user interface system 900 is not limited to the GUI window representations specifically illustrated in FIGS. 12-18. One skilled in the art would recognize how various components of the user interface system may be displayed somewhat differently than depicted in FIGS. 12-18.

FIG. 11 is a screen shot of an exemplary GUI window 1000 including a security network map 1010 for graphically displaying the arrangement and status of sensor nodes included within the network, a "Sensors" tab 1020 for textually displaying the status and alarm count associated with each sensor node, and an "Alarms" tab 1030 for displaying basic details about any warning/alarm signals generated for the sensor nodes.

Various views of the security network map 1010 can be displayed in all modes of operation. Certain views of the security network map 1010 can be stored as presets for the user interface system to call upon, e.g., during an alarm event. In the exemplary screen shot of FIG. 12, security network map 1010 displays an aerial image of a facility having a plurality of sensor nodes arranged around a perimeter of the facility grounds. Each of the sensor nodes is depicted by an icon or symbol, which is superimposed onto the aerial image to depict the actual location of a sensor node in the network. In addition to node placement, the sensor node icons provide visual indication as to the location of an alarm or warning signal. In one embodiment, the color of the sensor node icon depicted in the security network map 1010 may change to indicate a change in the sensor node status. For example, the sensor node icons may initially be green to indicate an Active status. However, the color of a sensor node icon may change to orange upon detecting a non-threat event, or red upon detecting a threat event. A purple icon may be used to indicate a Configure status. These colors are, of course, exemplary and non-limiting.

In a preferred embodiment, the security network map 1010 is interactive and allows a user to zoom in and out, and pan up, down, right, left. The interactive map 1010 also allows a user to click on a sensor node, multiple nodes or a zone for the purpose of accessing information about the node(s) or zone and/or for reconfiguring the node(s) or zone. An exemplary module 1040 for configuring one or more sensor nodes will be described in more detail below with reference to FIGS. 11-13.

As noted above, the "Sensors" tab 1020 provides a textual display of the status and alarm count associated with each sensor node. Information displayed in this tab is generated by the sensor node/zone status module 930 of the user interface system 900 shown in FIG. 11. Similar to the sensor node icons displayed on the security network map 1010, the color of the text displayed in the "Sensors" tab 1020 may also reflect the status of the sensor node. For example, the status may be displayed as green for Active, purple for Configure, orange for Warning or red for Alarm. In some embodiments, the "Sensors" tab 1020 may also be interactive. For example, a user may click on one or more sensor nodes to access information about the node(s) or reconfigure the node(s).

The "Alarms" tab 1030 displays basic details about any warning/alarm signals generated for the sensor nodes. Information displayed in this tab is generated by the event description module 940 of the user interface system 900 shown in FIG. 11 and may include the type of event (e.g., perimeter cut), the location of the event (e.g., at sensor 119) and the approximate threat level (e.g., alarm). Additional details may also be included. In some embodiments, the color of the text displayed in the Alarms tab 1030 may also reflect the approximate threat level. For example, the threat level may be displayed in orange "Warning" for non-threat events or red "Alarm" for threat events. In some embodiments, the "Alarm" tab 1030 may also be interactive. For example, a user may click on one or more alarm descriptions to access information about the alarms.

Figure 13:
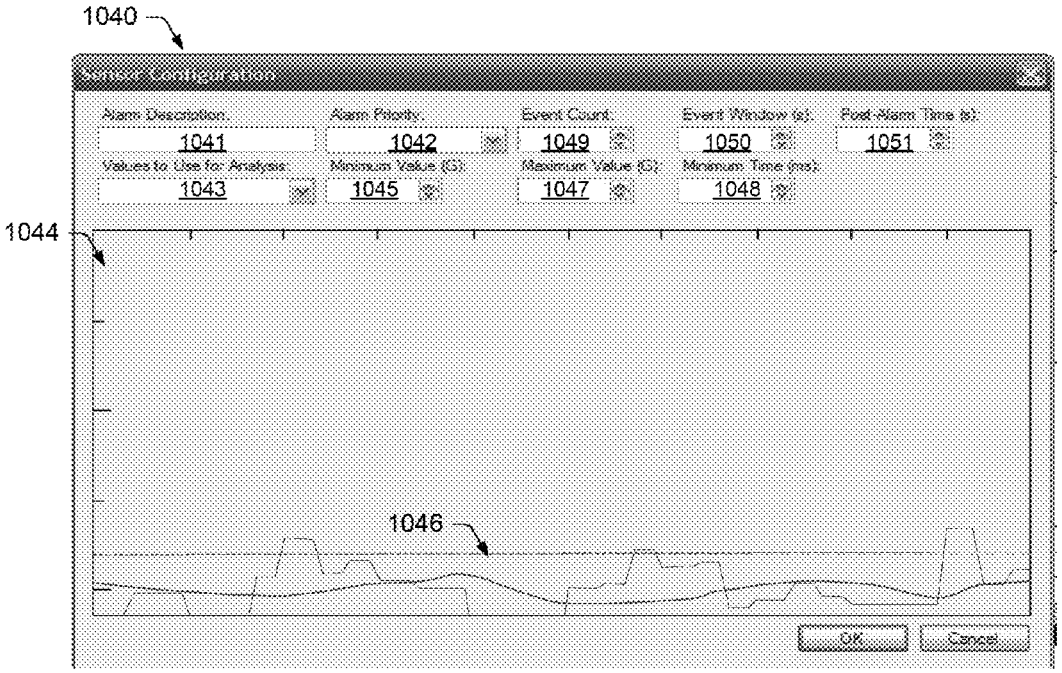
FIG. 13 is a screen shot of an exemplary sensor node/zone configuration window, which may be used to set and/or display event property filters for an individual node or a plurality of nodes grouped together in a zone.

FIG. 13 is a screen shot of an exemplary sensor node/zone configuration window 1040, which may be used for configuring one or more sensor nodes. As indicated above, the sensor node/zone configuration window 1040 may be accessed by clicking on one more mode sensor node icons graphically displayed in the security network map 1010, or by clicking on one or more sensor nodes textually displayed in the "Sensors" tab 1020. This is illustrated in the screen shot of FIG. 14.

Figure 14:
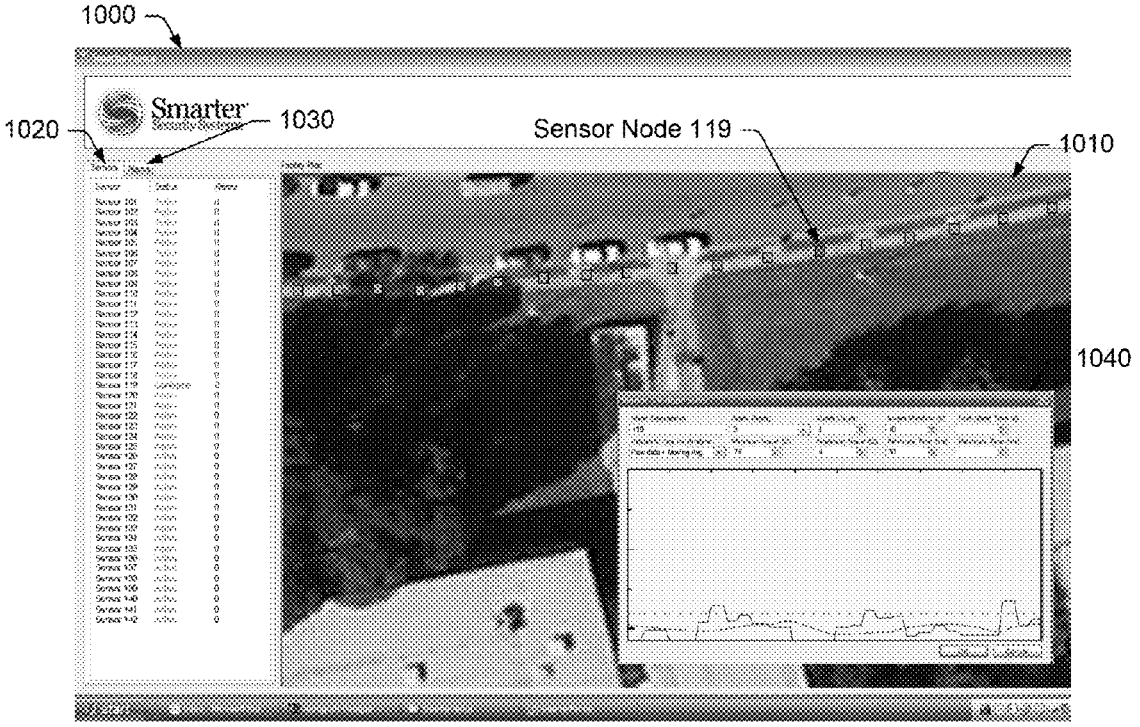
FIG. 14 is a screen shot of an exemplary sensor node/zone configuration window, illustrating one manner in which a single node may be configured by a user.

FIG. 14 is a screen shot of an exemplary sensor node/zone configuration window 1040, illustrating one manner in which a single node may be configured by a user. In order to configure (or reconfigure) sensor node 119, a user of the security system may access the sensor node/zone configuration window 1040 by clicking on the graphical representation of sensor node 119 in the security network map 1010, or by clicking on the textual display of sensor node 119 in the "Sensors" tab 1020. In doing so, the user interface system changes the status of sensor node 119 to Configure in the "Sensors" tab 1020 and calls up the sensor node/zone configuration window 1040. The user may now set or change the sensor configuration data specified for sensor node 119.

Figure 15:
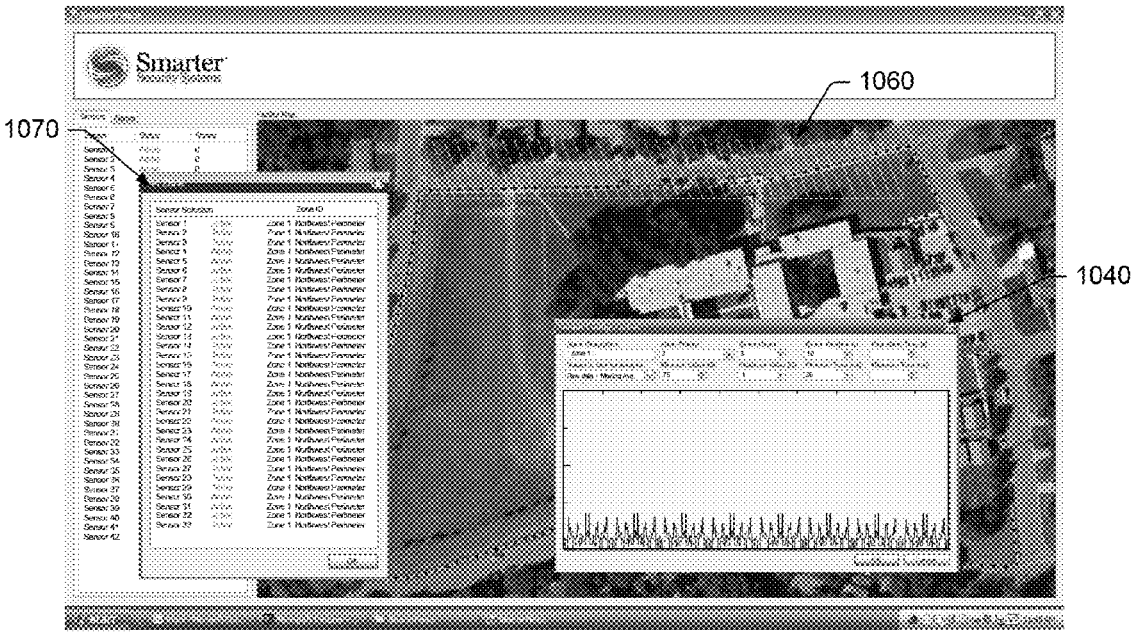
FIG. 15 is a screen shot of an exemplary sensor node/zone configuration window, illustrating one manner in which a plurality of nodes grouped into a zone may be configured by a user.

In some cases, it may be desirable to configure multiple sensor nodes in the same manner. FIG. 15 is a screen shot of an exemplary sensor node/zone configuration window 1040, illustrating one manner in which a plurality of nodes grouped into a zone may be configured by a user. As shown in FIG. 15, a plurality of nodes may be grouped into a zone by dragging a selection box 1060 around the sensor node icons, which the user wishes to configure similarly. In some cases, similar actions may be taken in the "Sensors" tab 1020. Selecting the sensor nodes in this manner brings up a "Set Zone" box 1070 for specifying a Zone ID for the zone, as well as the sensor node/zone configuration window 1040 for setting or changing the sensor configuration data for the entire zone.

As noted above, the sensor configuration data specifies a number of event property filters for each of the known events stored within the sensor nodes and the central processing and control system. The event property filters define a number of classification parameters that must be met in order to successfully detect and classify an event as one of the previously identified anomalous events. FIG. 13 illustrates a number of event property filters that may be set or changed within the exemplary sensor node/zone configuration window 1040.

In configuration mode, the alarm description box 1041 specifies the node (see, FIG. 14) or zone (see, FIG. 15) currently being configured. In addition, the alarm description box 1041 may also indicate the type of events (e.g., cut, climb, rain, etc.) that the node/zone is configured to detect. Once a node/zone is selected and a particular event is specified, a priority level may be assigned to the event in alarm priority box 1042. The alarm priority box 1042 allows the user to assign different levels of priority to an event based on data, such as the location of the event and desired response to the event. Levels of priority range from low level alerts to warnings to alarms. The user can specify what actions are taken for each priority level. This enables the system to respond to different events in different ways.

In one embodiment, the user may begin to configure a node/zone for a particular event by selecting the values to use for analysis from filter box 1043. This box may give the user the choice of selecting the raw sensor data from a particular sensor and/or a moving average of the raw sensor data. For example, when configuring the node/zone to detect a cut event, the raw sensor data may be selected as it will accurately depict the high frequency, short duration nature of a cut attack event signature. On the other hand, a moving average of the raw sensor data may be selected for detecting a climb attack, as the moving average will indicate this condition better than the raw sensor data. For some events, a composite image of the raw sensor data and the moving average may provide increased accuracy of detection. Once a selection is made, the values to be used for analysis are displayed in a graphical format in display box 1044. The graphical display may indicate trends in the sensor data, which can be used to select the appropriate classification parameters used by the sensor nodes and control system for successfully detecting and classifying events.

Upon analyzing the data displayed in box 1044, the user may select the appropriate classification parameters for one or more of the following event property filters shown in FIG. 13. These filters include, but are not limited to, the minimum threshold value filter 1045, the maximum threshold value filter 1047, the minimum time filter 1048, the event count filter 1049, the event window filter 1050 and the post alarm time filter 1051. The event property filters selected for configuration may depend, for example, on the sensor technology supplying the data, the location of the sensor node/zone being configured, and the event being configured. Thus, not all of the event property filters shown in FIG. 13 may be specified for every known event and every sensor node. Other event filters not specifically mentioned herein and shown in FIG. 13 may be included in other embodiments.

The minimum threshold value filter 1045 specifies the minimum energy threshold that the sensor data must meet to qualify as an event. The value specified in the minimum threshold value filter box 1045 is also known as the alarm threshold, or the minimum threshold that the sensor data must surpass before the central processing and control system will generate an alarm or warning signal for a detected event. This value gives the system the ability to ignore unwanted data, which is detected by the sensor but not sufficient to register as an event. In some embodiments, the alarm threshold level may be depicted in display box 1044 as a horizontal line 1046. This line may be adjusted up or down by changing the value within the minimum threshold value filter box 1045, thereby changing the sensitivity of detection.

The maximum threshold value filter 1047 sets a range for scaling the sensitivity of detection. This allows the system to start in a low, highly sensitive range of detection and adjust to a higher, less sensitive range as sensor data readings go off scale. There may also be times when it is advantageous to only detect events of small force, such as when trying to detect the cadence of footsteps along a monitored roadway or pathway. This may be achieved by setting the maximum threshold value filter box 1047 to a value representing a low, highly sensitive range.

The values set within the minimum time filter box 1048 set the time duration that the sensor data must maintain over the alarm threshold before it is registered as an event. This value is used along with the minimum event threshold to characterize the event requirements.

The event count filter 1049 specifies the number of registered events that must occur before the control system will generate a warning or alarm signal. The number of registered events specified in the event count filter 1049 will vary depending on the type of event to be detected. For example, less than five events may be sufficient to indicate to the control system that a cut attack is likely in progress. However, the control system may require substantially more or less registered events to confirm the identity of other types of events. For example, when attempting to detect a person walking along a pathway, substantially more events may be needed for the control system to establish the cadence or pattern of a pedestrian type event. The event count filter 1049 enables alarm generation to be tailored to the specific event being detected, and also reduces nuisance alarms by possibly preventing alarm signal generation for single events that may naturally occur in an outdoor environment.

The event window filter 1050 is another filter, which helps to reduce nuisance alarms. Values set within filter 1050 indicate the time period after detection of a registered event that the control system continues to count successive registered events for satisfying the event count. The time period specified in the event window filter 1050 will also vary depending on the type of event to be detected. For example, thirty seconds may be sufficient to accumulate the number of registered cut events needed to confirm a cut attack. On the other hand, ten seconds may be a reasonable time period for detecting a person climbing over the fence. Like the event count filter 1049, the values set within the event window filter 1050 enables alarm generation to be tailored to the specific event being detected, and reduces nuisance alarms by possibly preventing alarm signal generation for single events that may naturally occur in an outdoor environment.

The post alarm time filter 1051 specifies the minimum time between successive event notification messages, or the time duration that a sensor node must wait before transmitting another event notification message to the control system identifying the same event. For example, this time period can be adjusted by the control system after the control system receives a plurality of rain identifying messages from a group of sensor nodes. After acknowledging and confirming the rain event, the control system can increase the time period set in the post alarm time filter 1051, essentially instructing the sensor nodes to cease transmission of the rain identifying messages until the wait time expires or a resume signal is sent from the control system. It is important to note that while transmission of the rain identifying messages ceases during the wait period, the sensor nodes continue to detect the rain event and any other anomalous events that may occur during that time period.

Figure 16:
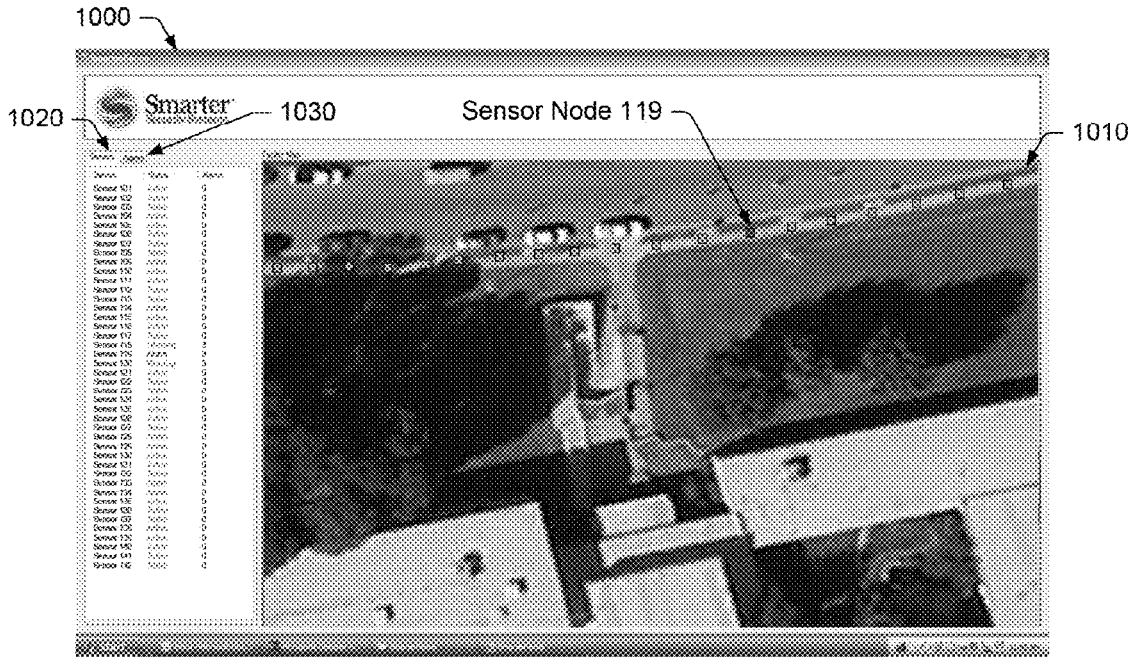
FIG. 16 is a screen shot of the user interface shown in FIG. 12, illustrating one manner in which an alarm condition at one of the sensor nodes may be displayed to the user.
Figure 17:
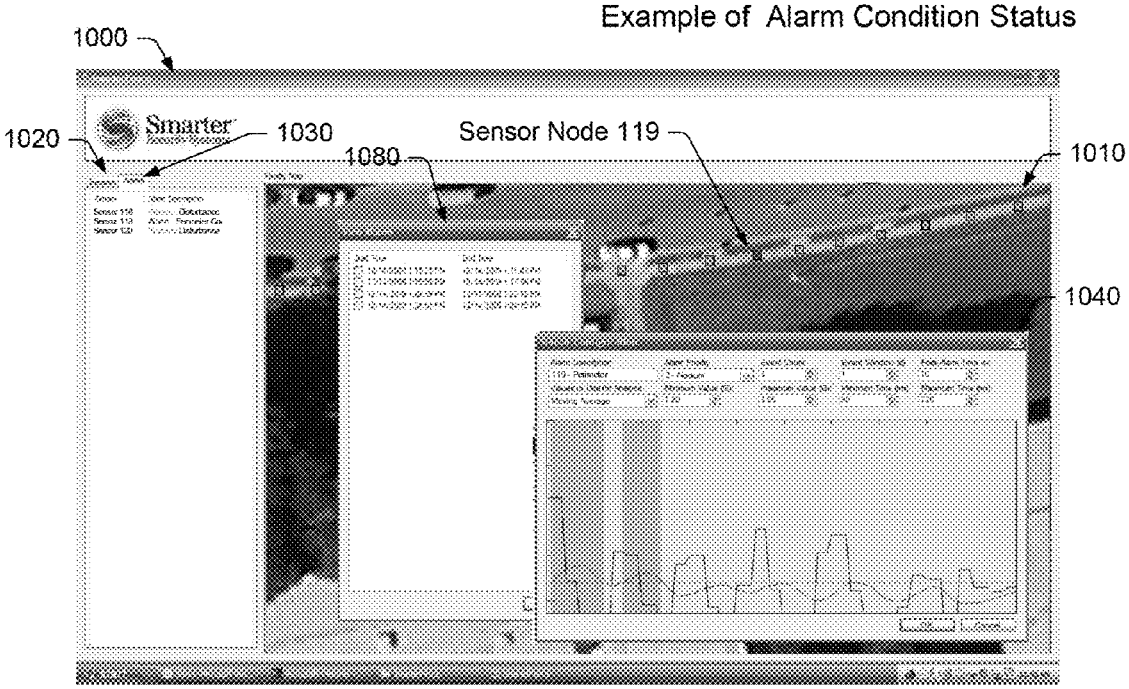
FIG. 17 is a screen shot of the user interface shown in FIG. 12, providing further details about the alarm condition shown in FIG. 16.

Exemplary embodiments for alerting the user to the occurrence of an anomalous event are illustrated in FIGS. 16-17. For example, FIG. 16 is a screen shot of GUI window 1000, illustrating one manner in which an alarm condition generated at one of the sensor nodes (sensor node 119) may be displayed to the user. Upon detecting an alarm condition (e.g., a perimeter cut) at sensor node 119 and a warning condition (e.g., a disturbance) at surrounding nodes 118 and 120, the control system instructs the user interface system to update the status of sensor nodes 118, 119 and 120 as shown in the security network map 1010 and the Sensors tab 1020. In some embodiments, the user interface system may change the color of the sensor nodes located at 118, 119 and 120 to emphasize the changed status. After updating the status of the sensor nodes, the security network map 1010 may automatically zoom in or pan over to the affected nodes, or the user may perform this function manually, to get visual confirmation of the nodes potentially under attack.

Details about the alarm condition may be obtained by clicking on the affected nodes in the security network map 1010 or in the listing of affected nodes in the Alarms tab 1030. During operational modes, the sensor node/zone configuration window 1040 is used to display information about the alarm conditions listed in the Alarms tab 1030. As shown in FIG. 17, the details displayed by the sensor node/zone configuration window 1040 during operational modes may include the alarm description (i.e., the location and type of event), the alarm priority level (e.g., 3—Medium) assigned to the detected event, the values used for analysis (e.g., the moving average), the minimum/maximum threshold levels required for the sensor values to register as an event, the minimum/maximum time duration that the sensor values must maintain to register as an event, the number of registered events (e.g., 3) that occurred during the event window (e.g., 1 sec), and the wait time specified (e.g., 10 sec) for sending event notification messages of identical events. These details may be displayed graphically in display box 1044 and/or textually in the event property filter boxes described above. In some embodiments, further details about the alarm condition (such as the data and time that events leading up to the alarm were detected) may be displayed in the View Alarms window 1080 by double clicking the reporting node listed in the Sensor tab 1020 or the Alarms tab 1030 or by right clicking the reporting node in sensor network map 1010.

Figure 18:
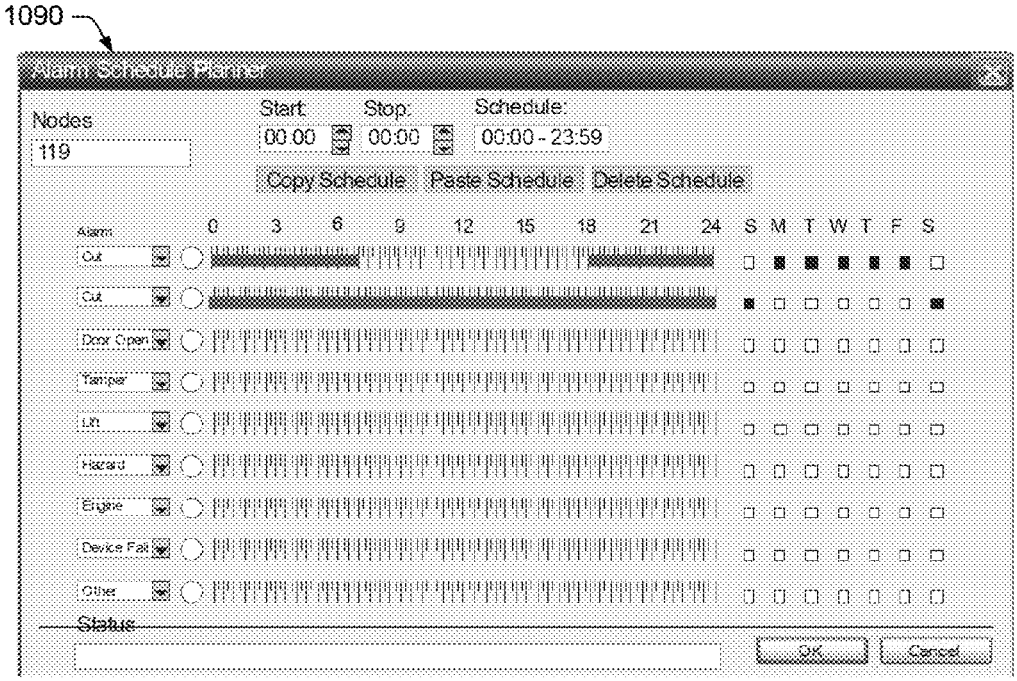
FIG. 18 is a screen shot of an activity scheduling module.

FIG. 18 illustrates one manner in which activity schedules may be programmed into the central processing and control system. In particular, FIG. 18 is a screen shot of an Activity Schedule window 1090 that may be used by a user of the security network for entering schedules for various events and locations into the activity scheduling module 970 of the user interface 900. As noted above, the activity scheduling module 970 enables the user of the security system or the control system to define times when certain actions are allowed or prohibited, so that the activity schedules can be used for detecting events, which occur at unusual or unauthorized times. The manual method for entering activity schedules in illustrated in FIG. 18.

Through the Activity Schedule window 1090, e.g., a user can schedule the times and days of the week that a variety of events (e.g., a cut, door open, tamper, lift, hazard, engine, device failure, etc.) should be monitored at a particular node. The Activity Schedule window 1090 also provides capabilities for copying and pasting activity schedules from one node to other nodes, and for deleting one or more previously programmed activity schedules.

It will be appreciated to those skilled in the art having the benefit of this disclosure that this invention is believed to provide an improved security network, which is significantly more configurable to a user's needs and adaptable to changes in the security network environment. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. A sensor node configured for detecting anomalous events in a security network, the sensor node comprising:

at least one sensor coupled for acquiring sensor data pertaining to the security network;

a storage medium coupled for storing:

a plurality of event signatures corresponding to previously identified anomalous events, wherein the previously identified anomalous events comprise threat-events and non-threat events;

a set of event property filters specified for each of the stored event signatures, wherein each set of event property filters defines a plurality of parameters that the sensor data must meet in order to detect an anomalous event in the sensor data, and wherein the set of event property filters comprise a minimum threshold value filter, a minimum time filter, and an event count filter; and a set of program instructions, which uses the plurality of event signatures and the sets of event property filters for detecting an anomalous event within the sensor data and, once the anomalous event is detected, the set of program instructions are configured for classifying the detected event as a threat-event, a non-threat event, or an unidentified event; and a processor coupled for executing the set of program instructions to detect and classify the anomalous event.

2. The sensor node as recited in claim 1, wherein the set of program instructions comprise:

first program instructions for comparing the sensor data to the plurality of event signatures, wherein if the first program instructions determine that the sensor data substantially matches one or more of the event signatures, the set of program instructions further comprise:

second program instructions for applying an appropriate set of event property filters corresponding to the one or more matching event signatures to the sensor data;

third program instructions for detecting an anomalous event only if the sensor data meets the parameters defined within the appropriate set of event property filters;

fourth program instructions for classifying the detected event as one of the previously identified anomalous events, wherein said classifying identifies the threat-event or the non-threat event corresponding to the one or more matching event signatures; and fifth program instructions for generating an event notification message including the identified event, wherein the event notification message is transmitted from the sensor node to the central processing and control system.

3. The sensor node as recited in claim 2, wherein if the first program instructions determine that the sensor data does not match any of the event signatures, the set of program instructions further comprise:

sixth program instructions for determining if the sensor data contains any suspicious attributes, wherein if suspicious attributes are detected, the set of program instructions further comprises:

seventh program instructions for detecting an unidentified event; and eighth program instructions for generating an unidentified event notification message, which is transmitted from the sensor node to the central processing and control system.

4. The sensor node as recited in claim 1, further comprising at least one transceiver coupled for communicating with the central processing and control system.

5. The sensor node as recited in claim 1, further comprising a power cell for providing power to the sensor node and an energy harvesting device for recharging the power cell.

6. The sensor node as recited in claim 1, wherein the at least one sensor comprises a plurality of sensors, at least some of which comprise a different sensor technology.

7. The sensor node as recited in claim 1, wherein if an anomalous event is detected and classified as a non-threat event, the processor is further coupled for receiving instructions for responding to the detected non-threat event from a central processing and control system of the security network.

8. The sensor node as recited in claim 1, wherein the set of event property filters further comprise one or more of a maximum threshold value filter, an event window filter and a post alarm time filter.

9. The sensor node as recited in claim 7, wherein the instructions received by the processor for responding to a detected non-threat event include modifying at least one parameter within the sets of event property filters, so as to effectively tune out the detected non-threat event, while the sensor node continues to monitor the security network for other anomalous events.

10. The sensor node as recited in claim 7, wherein the instructions received by the processor for responding to the detected non-threat event include at least one of the following instructions:

modify at least one parameter within the sets of event property filters, so as to effectively tune out the detected non-threat event, while the sensor node continues to monitor the security network for other anomalous events; and cease transmission of the event notification message identifying the detected non-threat event.

11. A method for detecting anomalous events at a sensor node arranged within a security network comprising a plurality of sensor nodes controlled by a central processing and control system, the method performed at the sensor node comprising:

acquiring sensor data pertaining to the security network;

detecting an anomalous event within the sensor data by:

comparing the sensor data to event signatures stored within the sensor node, wherein the event signatures correspond to previously identified anomalous events, including threat events and non-threat events, and wherein if the sensor data substantially matches one or more of the stored event signatures, the method further comprises:

applying a set of event property filters corresponding to the one or more matching event signatures to the sensor data, wherein the set of event property filters specify parameters that must be met in order to detect an anomalous event within the sensor data, and wherein the set of event property filters comprise a minimum threshold value filter, a minimum time filter, and an event count filter; and detecting an anomalous event only if the sensor data satisfies the parameters within the set of event property filters; and classifying the detected anomalous event as a threat-event or a non-threat event, wherein the classifying step identifies the threat-event or the non-threat event corresponding to the one or more matching event signatures.

12. The method as recited in claim 11, wherein after said classifying, the method further comprises:

generating an event notification message including the identified threat-event or non-threat event; and transmitting the event notification message to the central processing and control system.

13. The method as recited in claim 12, wherein if the event notification message identifies a non-threat event, the method further comprises at least one of the following:

changing a sensitivity level of at least one of the event property filters, so as to effectively tune out the detected non-threat event, while continuing to monitor the security network for other anomalous events; and ceasing transmission of the event notification message identifying the detected non-threat event.

14. The method as recited in claim 12, wherein if the event notification message identifies a threat event, the method further comprises receiving a request from the central processing and control system for transmitting additional data from the sensor node to the central processing and control system.

15. The method as recited in claim 11, wherein if the sensor data does not match any of the event signatures, the method further comprise:

determining if the sensor data contains any suspicious attributes, wherein if suspicious attributes are detected, the method further comprises:

detecting an unidentified event;

generating an unidentified event notification message; and transmitting the unidentified event notification message to the central processing and control system.

16. The method as recited in claim 11, wherein if the detected anomalous event is classified as a non-threat event, the method further comprises receiving instructions from the central processing and control system for responding to the non-threat.

17. The method as recited in claim 11, wherein the set of event property filters further comprise one or more of a maximum threshold value filter, an event window filter and a post alarm time filter.

18. A security network, comprising:

a plurality of sensor nodes interconnected to form a communication network, wherein each sensor node is configured for detecting an anomalous event occurring within a vicinity of the sensor node and for identifying the detected anomalous event as a specific threat-event, a specific non-threat event or an unidentified event; and a central processing and control system coupled to the plurality of sensor nodes for receiving an event notification message from at least one of the sensor nodes indicating an identity of an anomalous event detected by the at least one sensor node, wherein upon receiving the event notification message, the central processing and control system is configured for confirming the identity of the anomalous event provided by the at least one sensor node by applying a set of event property filters to the event notification message and for responding to the anomalous event once confirmation is made, wherein the set of event property filters comprise a minimum threshold value filter, a minimum time filter, and an event count filter.

19. The security network as recited in claim 18, wherein the central processing and control system is further configured for confirming the identity of the anomalous event provided by the at least one sensor node by comparing the event notification message to other event notification messages received from other sensor nodes.

20. The security network as recited in claim 18, wherein if the central processing and control system confirms the identity of an anomalous event as a specific threat event, the central processing system is further configured for:

generating an alarm signal attributed to the at least one sensor node;

forwarding the alarm signal to a user interface system of the security network for displaying and alerting a user to the specific threat event at the at least one sensor node;

responding to the alarm signal based on a priority setting specified for the specific threat event; and storing details of the specific threat event within an event log.

21. The security network as recited in claim 18, wherein if the central processing and control system confirms the identity of an anomalous event as a specific non-threat event, the central processing system is further configured for:

generating a warning signal attributed to the at least one sensor node;

forwarding the warning signal to a user interface system of the security network for displaying and alerting a user to the specific non-threat event at the at least one sensor node;

sending instructions to the at least one sensor node for responding to the specific non-threat event; and storing details of the specific non-threat event within an event log.

22. The security network as recited in claim 21, wherein the instructions sent to the at least one sensor node for responding to the specific non-threat event comprise at least one of the following:

changing a sensitivity level of at least one parameter used by the at least one sensor node for detecting and identifying the specific non-threat event, so that the at least one sensor node can ignore the specific non-threat event, while continuing to monitor the security network for other anomalous events; and ceasing transmission of the event notification message identifying the specific non-threat event.

23. The security network as recited in claim 18, wherein if the central processing and control system confirms the identity of an anomalous event as an unidentified event, the central processing system is further configured for storing details of the unidentified event within an event log.

24. The security network as recited in claim 23, wherein the central processing and control system is further configured for analyzing the details of the unidentified event stored within the event log in order to identify the unidentified event.

25. The security network as recited in claim 23, wherein the central processing and control system is further configured for predicting the occurrence of a future threat event by analyzing details of unidentified events stored within the event log over time.

26. The security network as recited in claim 18, further comprising a user interface system in communication with the central processing and control system, wherein the user interface system comprises a graphical user interface (GUI) including a user-interactive map of the security network for displaying the location and status of each of the sensor nodes.

27. The security network as recited in claim 26, wherein the GUI comprises graphical and textual means for:

displaying a status of one or more of the sensor nodes;

displaying details of a specific threat-event, a specific non-threat event or an unidentified event detected by one or more of the sensor nodes;

displaying a historical log of events associated with one or more of the sensor nodes; and selecting operational settings of one or more of the sensor nodes, wherein said selecting comprises setting sensitivity levels of parameters used by the sensor nodes for detecting and identifying the specific threat events and the specific non-threat events, and assigning priority settings for responding to the specific threat events.

* * * * *